US007389062B2

(12) United States Patent
Hashimoto et al.

(10) Patent No.: US 7,389,062 B2
(45) Date of Patent: Jun. 17, 2008

(54) IMAGE FIXING APPARATUS AND IMAGE FORMING APPARATUS

(75) Inventors: Tatsuaki Hashimoto, Abiko (JP); Takashi Yano, Shizuoka-ken (JP)

(73) Assignee: Canon Kabushiki Kaihsa, Tokyo (JP)

( * ) Notice: Subject to any disclaimer, the term of this patent is extended or adjusted under 35 U.S.C. 154(b) by 350 days.

(21) Appl. No.: 11/096,128

(22) Filed: Apr. 1, 2005

(65) Prior Publication Data

US 2005/0220505 A1 Oct. 6, 2005

(30) Foreign Application Priority Data

Apr. 2, 2004 (JP) ..... 2004-110182

(51) Int. Cl.
*G03G 15/20* (2006.01)

(52) U.S. Cl. ..... 399/68; 399/322

(58) Field of Classification Search ..... 399/68, 399/320, 322, 328, 341, 400, 406; 219/216
See application file for complete search history.

(56) References Cited

U.S. PATENT DOCUMENTS

| | | | | |
|---|---|---|---|---|
| 5,296,904 | A * | 3/1994 | Jackson | 399/328 |
| 5,519,484 | A * | 5/1996 | Kumagai | 399/364 |
| 5,557,369 | A | 9/1996 | Shiga et al. | 355/204 |
| 6,125,248 | A * | 9/2000 | Moser | 399/68 |
| 6,260,840 | B1 | 7/2001 | Suga et al. | 271/10.12 |
| 6,382,622 | B1 | 5/2002 | Takada et al. | 271/122 |
| 6,467,767 | B2 | 10/2002 | Yano | 271/122 |
| 6,512,914 | B2 | 1/2003 | Kabashima | 399/341 |
| 6,615,018 | B2 * | 9/2003 | Funato | 399/322 |
| 6,826,383 | B2 | 11/2004 | Yano | 399/389 |
| 6,980,762 | B2 * | 12/2005 | Bogoshian | 399/328 |
| 6,988,727 | B2 | 1/2006 | Yano | 271/264 |
| 7,072,610 | B2 * | 7/2006 | Nakane | 399/328 |
| 2005/0035539 | A1 | 2/2005 | Hashimoto | 271/265.01 |

(Continued)

FOREIGN PATENT DOCUMENTS

JP 6-348159 12/1994

(Continued)

OTHER PUBLICATIONS

U.S. Appl. No. 11/452,951, filed Jun. 15, 2006, Yano.

(Continued)

*Primary Examiner*—Robert Beatty
(74) *Attorney, Agent, or Firm*—Fitzpatrick, Cella, Harper & Scinto

(57) ABSTRACT

An image fixing apparatus includes a first conveying path on which a sheet is conveyed, a first fixing unit that fixes a toner image on a sheet conveyed on the first conveying path, a second conveying path on which a sheet is conveyed, wherein the second conveying path branches from the first conveying path in a bifurcation provided on a upstream of the first fixing unit and joins into the first conveying path in a confluence provided on a downstream of the first fixing unit, and a second fixing unit provided on a upstream of the bifurcation or on a downstream of the confluence or on the second conveying path. Time to convey a sheet from the bifurcation to the confluence through the first conveying path and time to convey a sheet from the bifurcation to the confluence through the bypass conveying path are nearly equal.

7 Claims, 14 Drawing Sheets

U.S. PATENT DOCUMENTS

| | | | | |
|---|---|---|---|---|
| 2005/0220505 | A1 | 10/2005 | Hashimoto et al. | 399/322 |

FOREIGN PATENT DOCUMENTS

| | | | | |
|---|---|---|---|---|
| JP | 7-271226 | | | 10/1995 |
| JP | 08272159 | A | * | 10/1996 |
| JP | 09160311 | A | * | 6/1997 |
| JP | 2000-44102 | | | 2/2000 |
| JP | 2001-5319 | | | 1/2001 |
| JP | 2002-667 | | | 1/2002 |
| JP | 2002-372882 | | | 12/2002 |
| JP | 2003-24839 | | | 1/2003 |

OTHER PUBLICATIONS

Chinese Office Action dated Nov. 23, 2007, in Chinese Application No. 2005100628543.

* cited by examiner

IMAGE FIXING APPARATUS AND IMAGE FORMING APPARATUS

BACKGROUND OF THE INVENTION

1. Field of the Invention

The present invention relates to an image fixing apparatus which fixes an image on a sheet, and an image forming apparatus having the image fixing apparatus.

2. Related Background Art

Generally, an image forming apparatus fixes an unfixed image, drawn on a sheet by toner, on the sheet by heating and pressurizing in a fixing unit. The fixing unit is heated by an internal heater, and is controlled to maintain temperature necessary for fixing, with compensating heat amount taken by the sheet to pass.

Now, types of sheet material transferred by an image forming apparatus increase every year, and it is hard to reconcile the fixability, image quality of a fixed image, and productivity, which are stabilized to all the material, with each other in the structure of one fixing unit performing image fixing. What is adopted so as to correspond to this is a method that a plurality of fixing units are located in series in a conveying path to avoid the problems resulting from one fixing unit structure including the lack of heat amount (refer to Japanese Patent Application Laid-Open No. H07-271226).

In addition, the structure which is also disclosed is one that a first fixing portion which fixes toner to a print medium in a glossy state, and a second fixing portion which fixes toner to a print medium in a lusterless state are provided, and a recording medium is selectively conveyed to either of the two fixing portions (refer to Japanese Patent Application Laid-Open Nos. 2002-372882 and H06-348159).

Furthermore, there is material, whose fixability can be satisfied by one fixing unit and which causes problems of curling and coiling around a fixing roller when surplus heat amount is applied, such as paper with small basic weight, which is called plain paper, and a second side of thick paper (a moisture content drops and sheet temperature also rises). What are disclosed in U.S. Pat. No. 6,512,914 and Japanese Patent Application Laid-Open No. 2001-005319 so as to correspond to such material are the structure that an additional conveying path (bypass conveying path) which branches from a conveying path (main conveying path), where two fixing units are provided, to bypass a fixing unit in a downstream side between the two fixing units is provided.

Nevertheless, there is a possibility that, in such structure, intervals of sheets which are regularly conveyed in equal sheet intervals till a point of entering a bifurcation between the main conveying path and bypass conveying path become uneven in the downstream of the confluence between the main conveying path and bypass conveying path. Sheet conveyance in such uneven intervals interferes with the motion control of sheets, and causes a malfunction, for example, when a sheet reversing mechanism, a double-side path, a post treating apparatus, and the like are provided in the downstream of the confluence. In addition, there is also a possibility that a preceding sheet and a subsequent sheet may collide in the confluence to generate a jam, according to the relationship between the relative difference between path lengths and paper interval distance.

In addition, when wide initial sheet intervals are taken before inrush into the fixing unit so that a minimum sheet interval necessary for control is secured even if a sheet passes any of the main conveying path and bypass conveying path, there arises a problem that the productivity of an apparatus drops in the case of a job which uses both the main conveying path and bypass conveying path.

SUMMARY OF THE INVENTION

The present invention aims at providing an apparatus which can respond and stably convey sheets even if a sheet, which passes a plurality of fixing units, and a sheet, which bypasses at least one of the plurality of fixing units, are mixed in one job.

In order to attain the above-mentioned object, an image fixing apparatus according to the present invention comprises:

a first conveying path on which a sheet is conveyed;

a first fixing unit that fixes a toner image on a sheet conveyed on said first conveying path;

a second conveying path on which a sheet is conveyed, wherein said second conveying path branches from said first conveying path in a bifurcation provided on a upstream of said first fixing unit and joins into said first conveying path in a confluence provided on a downstream of said first fixing unit; and a second fixing unit provided on a upstream of said bifurcation or on a downstream of said confluence or on said second conveying path, wherein time to convey a sheet from said bifurcation to said confluence through said first conveying path and time to convey a sheet from said bifurcation to said confluence through said second conveying path are nearly equal.

DETAILED DESCRIPTION OF THE PREFERRED EMBODIMENTS

The present invention will be specifically explained below with citing embodiments. In addition, these embodiments are examples of the best embodiments in the present invention, but the present invention is not limited to these.

First Embodiment

Figure 6:
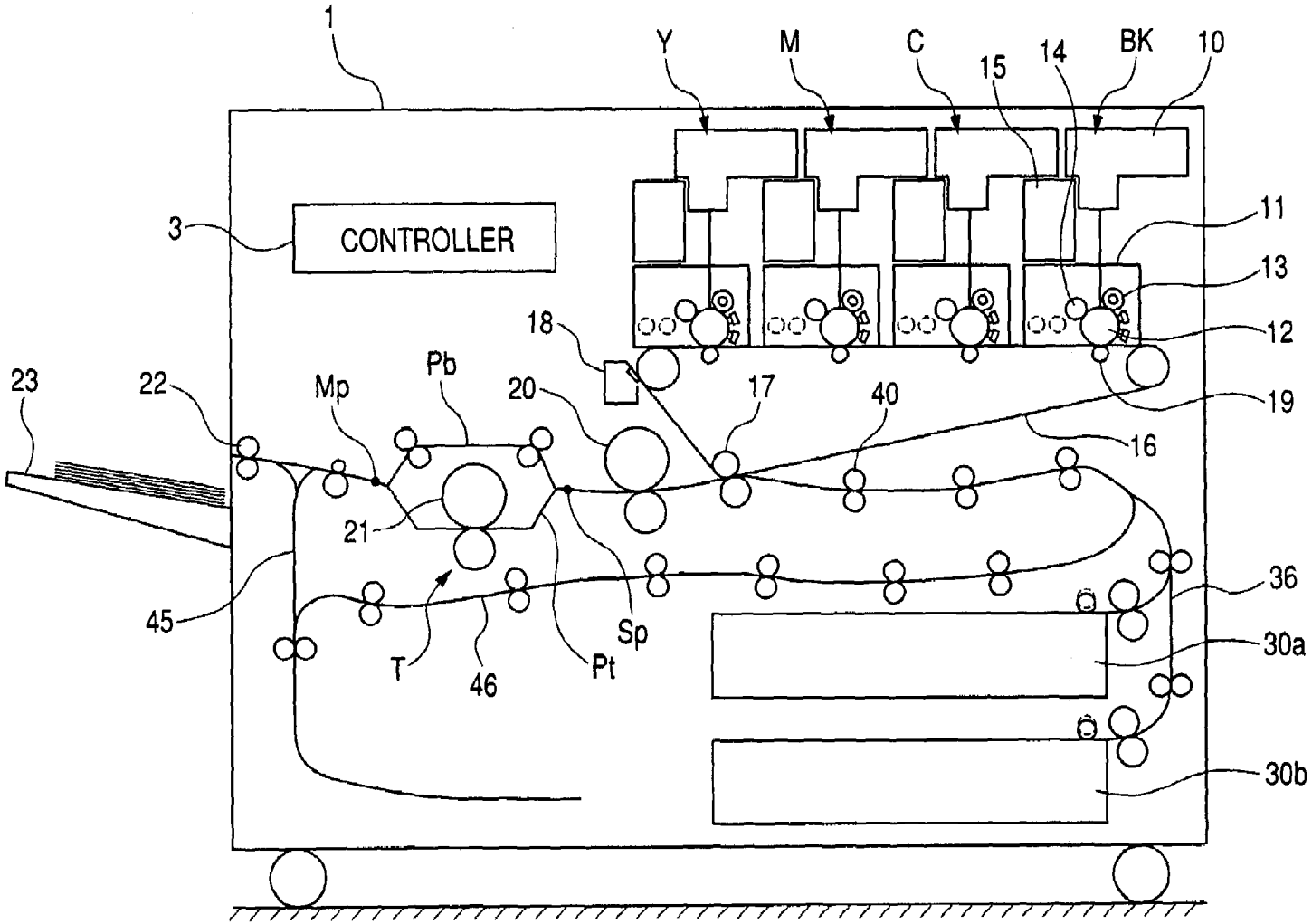
FIG. 6 is a schematic sectional diagram of an image forming apparatus of the first embodiment.

A first embodiment of the present invention will be explained using FIGS. 1, 2, 3 and 6. FIG. 6 shows a schematic section of an image forming apparatus to which the present invention is applied. Reference numeral 1 denotes a printer main body, and primary image forming portions Y, M, C and BK for forming respective yellow, magenta, cyan, and black primary images are located in the upper portion of the main body 1 of the printer. Print data transmitted from external equipment such as a personal computer is received by a controller 3 which controls the printer main body 1, and is outputted to a laser scanner 10 for each color as write image data.

A laser scanner emits a laser beam onto a photosensitive drum 12, and draws an optical image according to the write image data.

Each primary image forming portion comprises a photosensitive drum 12, a charging device 13 for uniformly charging a surface of the photosensitive drum 12, a developing device 14 for developing an electrostatic latent image formed by the above-mentioned laser scanner 11 drawing the optical image on the surface of the photosensitive drum 12 charged by the charging device 13 into a toner image which should be transferred to an intermediate transfer belt, a primary transfer roller 19 for transferring the toner image, developed on the surface of the photosensitive drum 12 to the intermediate transfer belt 16, and a cleaner (not shown) for removing the toner, which remains on the photosensitive drum 12, after transferring the toner image. Although the primary image forming portion Y which forms an yellow image is explained in FIG. 6 with being given reference numeral, all the magenta primary image forming portion M, cyan primary image forming portion C, and black primary image forming portion Bk comprise the same structure as that of the yellow primary image forming portion Y. Respective color toner images are transferred by respective primary image forming portions Y, M, C and Bk on the intermediate transfer belt 16. That is, by toner images being sequentially superimposed and transferred by the primary image forming portions Y, M, C and Bk on an outer peripheral surface of the intermediate transfer belt 16, a synthetic color toner image corresponding to a target color image is formed on the outer peripheral surface of the intermediate transfer belt 16. The synthetic color toner image which is primarily transferred to the intermediate transfer belt 16 is transferred on a sheet in a secondary transfer roller 17. The toner which remains without being transferred by the secondary transfer roller 17 is recovered by a cleaner 18.

A sheet feeding portion 30 is positioned in the uppermost stream of sheet conveyance, and is provided in two-step structure (30*a* and 30*b*) in a lower portion of the apparatus in a printer of this embodiment. A sheet which is fed from the sheet feeding portion is conveyed through a vertical conveyance path 36 to the downstream. There is a registration roller pair 40 in a lowermost stream position of the vertical conveyance path 36, and here, the final skew conveying correction of a sheet, and synchronization of image writing in an image forming portion, and the timing of sheet conveyance is performed.

In the downstream of the image forming portion, an image fixing apparatus T is provided so as to fix the toner image on a sheet S as a permanent image. An image fixing apparatus T comprises a second fixing device 20, and a first fixing device 21 for performing additional fixing for a sheet passing the second fixing device 20 according to a request. Both the second fixing device 20 and first fixing device 21 fix toner on a sheet with heat from a heating member, and nip pressure of a rotor pair, with nipping and conveying the sheet by the rotor pair.

The second fixing device 20 and first fixing device 21 are provided in a first path Pt which is a main conveying path. A second path (bypass) Pb is a second conveying path for bypassing a first fixing device and conveying a sheet. Thus, second path Pb branches from the first path Pt at a bifurcation point Sp which is provided in the downstream of the first fixing device 20 and in the upstream of the first fixing device 21. The second path Pb join again into the first path Pt at a confluence point Mp that is provided in the downstream of the first fixing device 21.

A flapper F which is a conveying path switching member for switching between paths in which each sheet is conveyed is provided at the bifurcation point Sp which is a bifurcation. By changing a position of the flapper F according to a request signal from the controller 3, it becomes possible to select either of the first path Pt and second path Pb for conveying a sheet.

A discharging roller 22 for discharging the sheet S, on which the toner image is fixed, from the printer main body 1 is provided in the downstream of the confluence point Mp which is the confluence, and a sheet discharging tray 23 for receiving the sheet S discharged from the discharging roller 22 is constituted in the outside of the printer main body 1. What are provided after the first path Pt and second path Pb join are a reverse conveying path 45 which branches from the conveying path leading the sheet to the sheet discharging tray 23 and reverses the sheet, and a double-sided conveying path 46 which leads again the sheet, reversed by the reverse conveying path 45, to the image forming portion. The sheet passing through the double-sided conveying path 46 is conveyed again to the image forming portion, and an image can be formed in a second face of the sheet. In addition, it is also good to remove the sheet discharging tray 23 and to provide a post treating apparatus for performing post-treating such as stapling and drilling.

In this embodiment, material, whose fixability can be satisfied by one fixing unit and which will generate problems such as curling and coiling around a fixing roller at the time of excessive heat amount beings applied by being made to pass two or more fixing units, such as plain paper and a second face of thick paper, is made to bypass the first fixing device 21 by being made to pass the second path Pb. Since much heat amount is necessary for favorable fixing, a first face of thick paper and coated paper which is requested for the gloss of a fixed image are made to pass both the second fixing device 20 and first fixing device 21 by being conveyed on the first path Pt.

Figure 1:
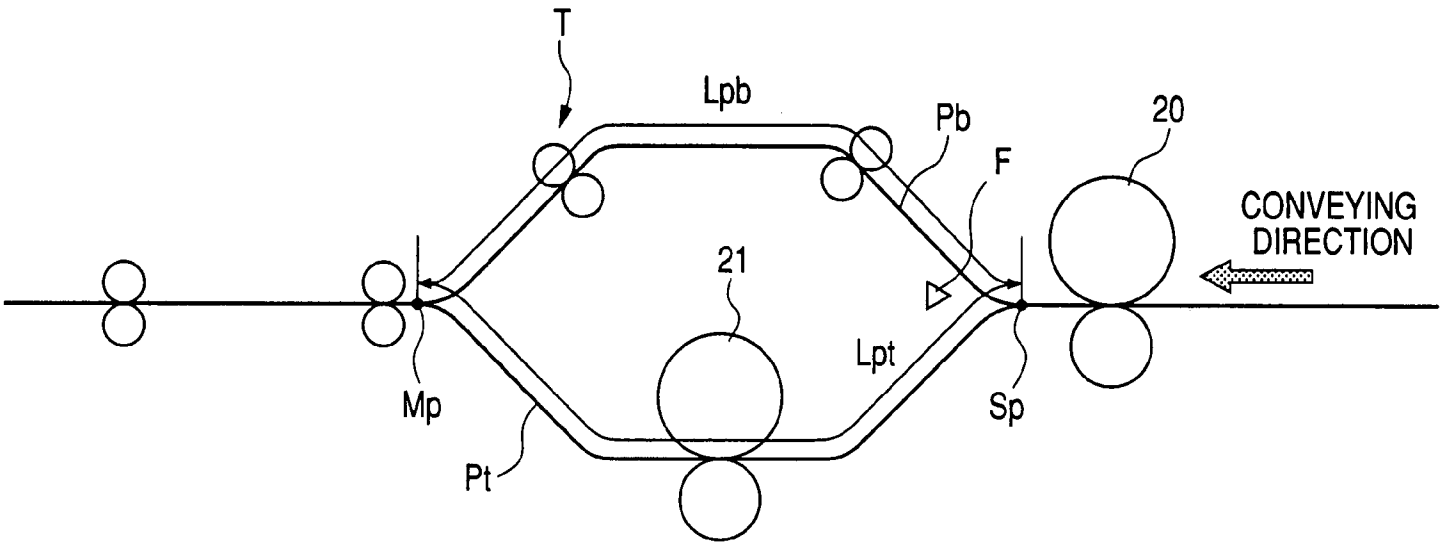
FIG. 1 is a sectional layout drawing in an image fixing apparatus of a first embodiment.

The detail of the image fixing apparatus T based on the present invention will be explained below. FIG. 1 shows a schematic section of the image fixing apparatus T in this embodiment. The structure of the fixing apparatus comprising the second fixing device 20, first fixing device 21, first path Pt, and second path Pb is the same as that explained schematically previously.

The conveyance sequence in the first path Pt and second path Pb is set so that the arrival time of a sheet from the bifurcation point Sp to the confluence point Mp may become almost equal. What is necessary is just to set the sequence so that the difference of sheet arrival time may become within 100 ms with forecasting, for example, the detection margin of detecting means, which detects the sheet arrival time, in consideration of the dispersion in sheet arrival timing to the confluence point Mp.

In this embodiment, when path lengths from the bifurcation point Sp to the confluence point Mp are compared with each other, a path length Lpb from the bifurcation point Sp to the confluence point Mp in the second path Pb, and a length Lpt from the bifurcation point Sp to the confluence point Mp in first path Pt are constituted so that they may become almost equal. Here, what is necessary is just to constitute both paths so that the difference between Lpb and Lpt may become not larger than 20 mm in the case that conveying speed is about 200 through 400 mm/s, in consideration of an allowable range of dispersion in the sheet arrival timing.

Figure 2:
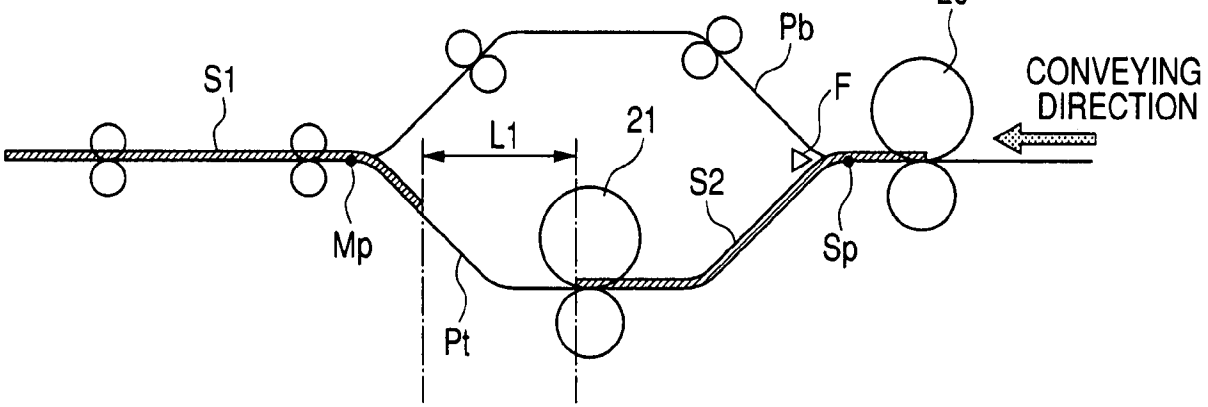
FIG. 2 is a sectional layout drawing for the explanation of operation in the image fixing apparatus of the first embodiment.
Figure 3:
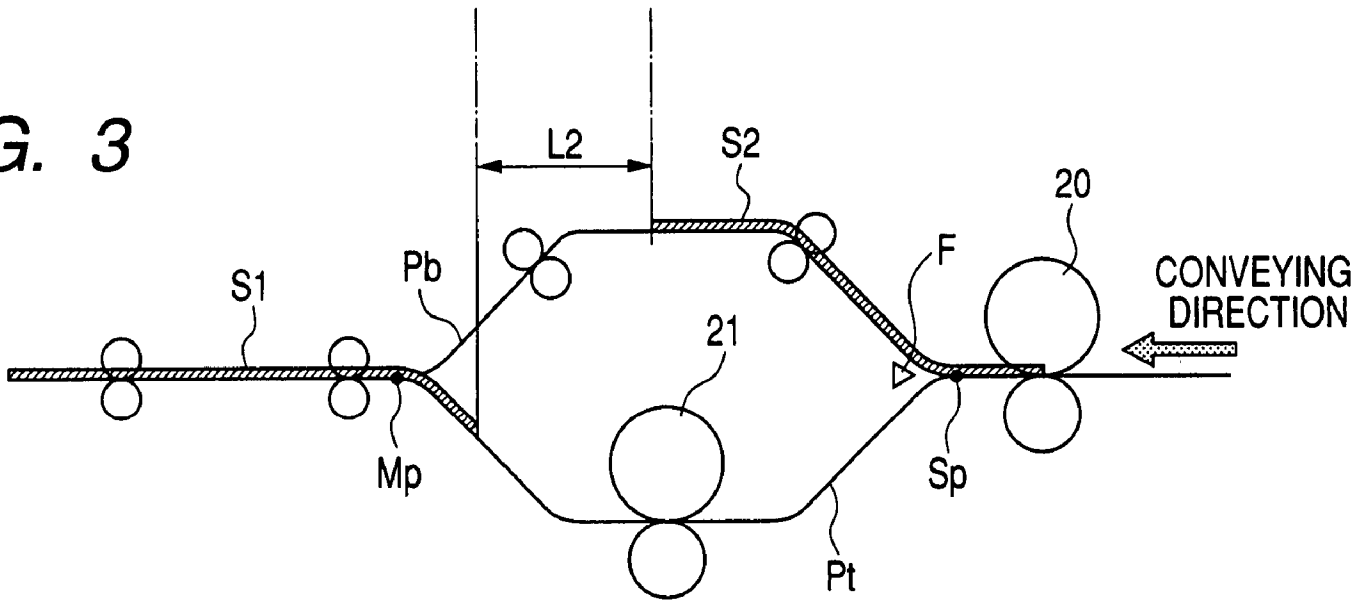
FIG. 3 is a sectional layout drawing for the explanation of operation in the image fixing apparatus of the first embodiment.

Therefore, for example, as shown in FIG. 2, let a paper interval distance between a preceding sheet S1 and a next conveyed sheet S2 be L1 in the case of conveying them by using only the first path Pt, and, as shown in FIG. 3, a paper interval distance L2 between a sheet S1, which is conveyed with preceding on the first path Pt, and a sheet S2, which is conveyed on the second path Pb, becomes nearly equal to L1 by the sheets being conveyed at the same speed on both the conveying paths. Hence, the timing which the sheets arrive at the confluence point becomes nearly equal, respectively.

According to this structure, when conveying sheets from a sheet bundle composed of sheets having different frequencies to pass through fixing units depending on the glossy difference requested for every sheet, the timing of the sheets which arrive at the confluence point always becomes nearly equal even if the sheets are conveyed with the first path Pt and second path Pb being switched suitably. Hence, regardless of a job using only one between the first path Pt and bypasses Pb and a mixing job using the first path Pt and second path Pb by turns in one job, it becomes possible to perform image forming operation in the maximum productivity of the apparatus. In addition, sheet conveyance intervals after fixing (when conveying sheets in the downstream of the confluence Mp) are equalized even in the case of a mixing job using the first path Pt and second path Pb by turns in one job. Hence, even if a sheet is reversed after unification, it is possible to stably perform operation relating to sheet conveyance. In addition, even in the case that, for example, a post treating apparatus is mounted in the downstream of a printer, it is also possible to perform the motion control of the post treating apparatus stably.

Thus, in the case that plain paper and a second face of thick paper, which pass only one fixing unit, and a first face of thick paper and coated paper, which pass two fixing units, are mixed in one job, and both of a main conveying path and a second conveying path are used, it is possible to continue sheet conveyance after a confluence at the almost same intervals as that before a bifurcation regardless of which conveying path a sheet has passed. Therefore, it is possible to prevent a malfunction from arising by conveying motion control after joining being interfered.

Figure 4:
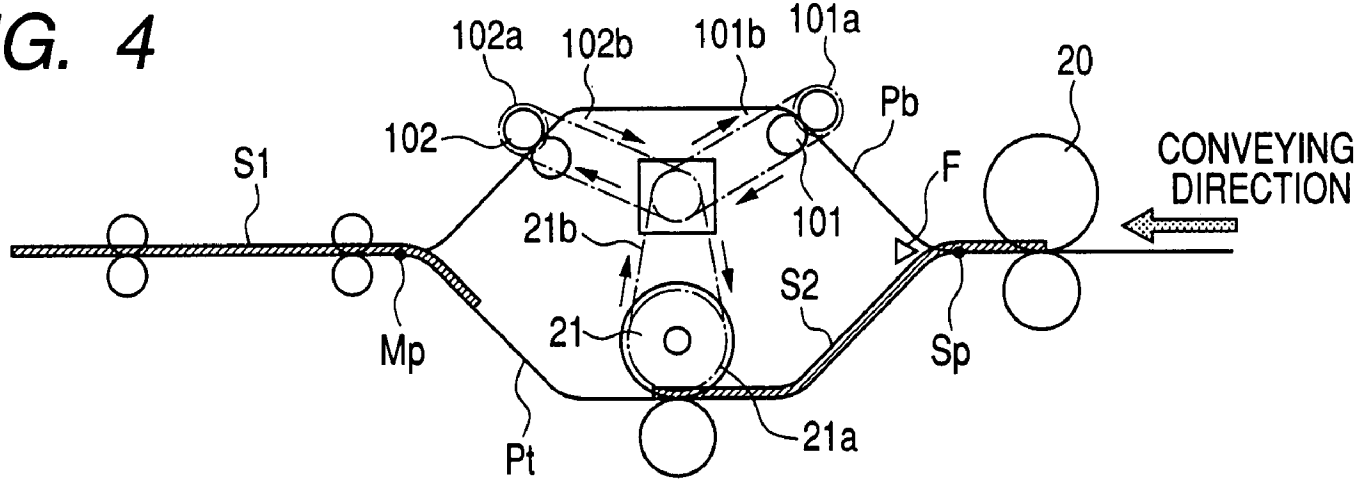
FIG. 4 is a sectional layout drawing showing a drive mechanism of the image fixing apparatus in the first embodiment.

FIG. 4 is a sectional layout drawing for explaining a drive mechanism in an image fixing apparatus. FIG. 4 shows a drive motor M for driving a first fixing device 21, a pair of conveying rollers 101 and 102 which are provided in the second path Pb, pulleys 101*a* and 102*a* which are provided in the transfer rollers 101 and 102, a pulley 21*a* which is provided in the first fixing device 21, and drive transmission belts 101*b*, 102*b* and 21*b* which are suspended on respective pulleys and serve for transmitting a driving force of the drive motor M.

A timing belt 103 transmits the driving force of the drive motor M to the pair of conveying rollers 101 through the pulley 102.

The pair of conveying rollers 101 and 102 and first fixing device 21 are driven by the drive of the drive motor M. Thus, the drive force for conveying a sheet is transmitted from the same drive source in the first path Pt and second path Pb, respectively. A reduction ratio of each pulley is set so that the conveying speed of a sheet may become fixed on the first path Pt and second path Pb, by rotating the drive motor M at fixed rotating speed.

In this way, since the first path Pt has the same path length as that of the second path Pb, it becomes easy to make such structure that one drive motor drives rotors (the transfer rollers 101 and 102, and a fixing roller of the fixing unit 21) for conveying a sheet in both of the paths. Thus, it becomes possible to provide a tandem system of image fixing apparatus which has simple and inexpensive structure.

Modified Example of First Embodiment

Figure 5:
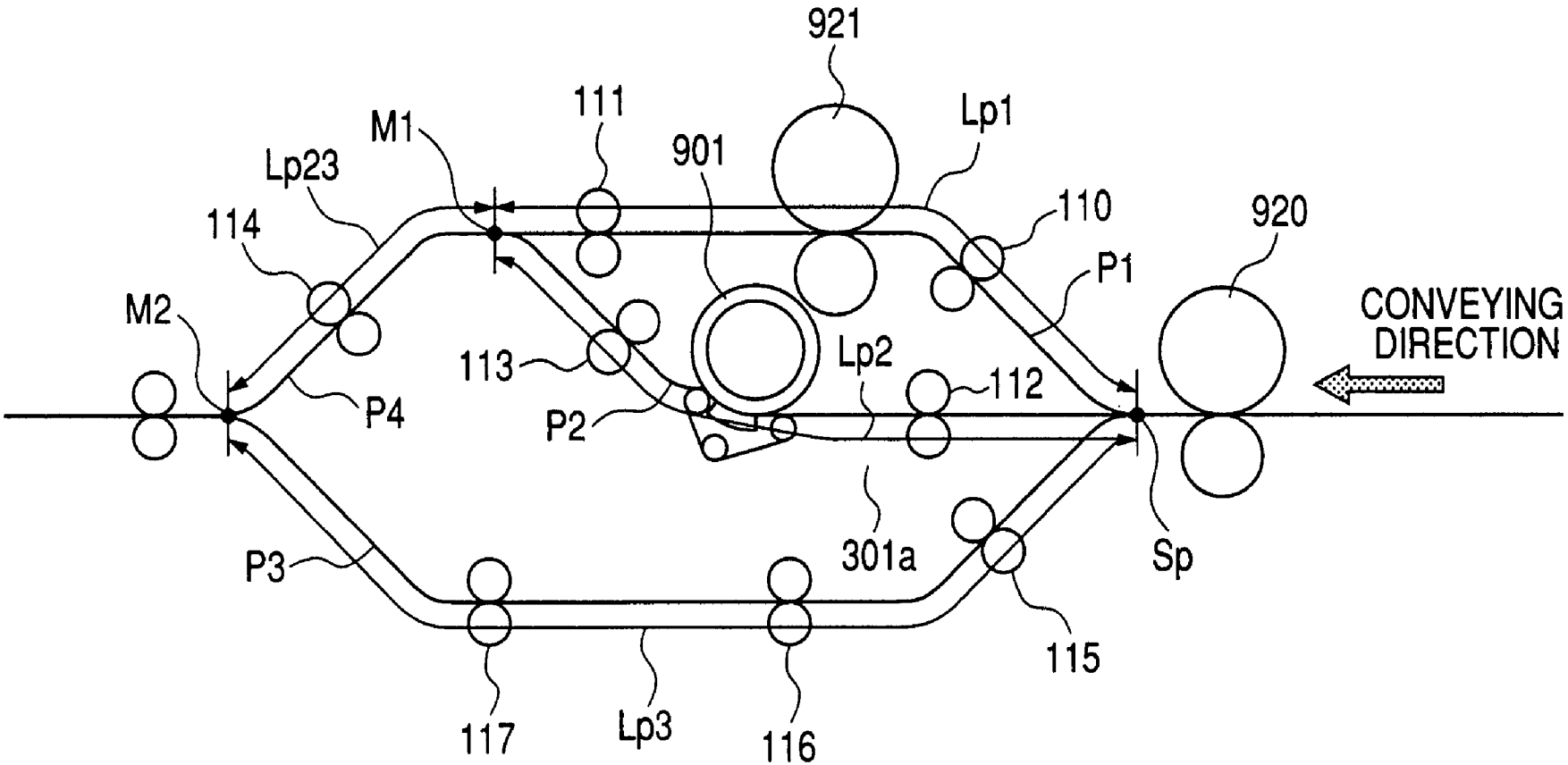
FIG. 5 is a sectional layout drawing of a modified example of the first embodiment.

FIG. 5 shows a sectional layout drawing of an image fixing apparatus which is a modified example of the first embodiment. In this figure, a path P1 which passes a first fixing device 921 for achieving high glossiness, a path P2 which passes a second fixing unit 901 provided with a belt pressing part 901*a* for achieving further high-level glossiness, and a path P3 without a fixing unit which passes a sheet when glossiness is not especially required are provided in the downstream of the third fixing device 920. Thus, different types of fixing units are provided in the path P1 and path P2.

In addition, a bifurcation point Sp where each path branches, a first confluence point M1 where the paths P1 and P2 join, a path P4 in the downstream of the first confluence point M1, and a second confluence point M2 where the paths P3 and P4 join are provided.

Furthermore, respective pairs of conveying rollers 110 through 117 are provided on respective paths, and switching means which switches a path where a sheet is conveyed is provided in each bifurcation point.

In this structure, path lengths Lp1 and Lp2 of paths P1 and P2 from the bifurcation point Sp to the first confluence point M1 are nearly equal. Furthermore, this has such structure that, let a path length of the path P4 be Lp23, and $Lp3 \leqq Lp1 + Lp23 \leqq Lp2 + Lp23$ holds.

Moreover, all of the sheet conveying speed of the pairs of conveying rollers 110 through 117, the sheet conveying speed of the first fixing device 921, and the sheet conveyance speed of the second fixing unit 901 are set to be nearly equal.

According to this structure, it is possible to obtain the same effect as that of the first embodiment, since the timing of a sheet which arrives at a confluence point becomes always nearly equal even if which path is passed since each path length is nearly equal. Further, it is possible to achieve glossiness in an optimal level by arranging fixing units, whose glossy level differ, in respective paths, and switching between paths so that second fixing may be performed by an optimal fixing unit, or selecting a path so that the second fixing may be not performed even when a glossy range requested for every sheet is wider.

Here, the path length from the bifurcation point Sp to the first fixing device 921 may be made to be nearly equal to the path length to the second fixing unit 901. Thereby, there are effects that, when the glossiness in a very high level is required, it is possible to make the same control performed in any path even when performing such complicated control that a sheet conveyed at uniform speed V in the third fixing device 920 is decelerated on the paths P1 and P2, and is accelerated after escaping from the nip of the first fixing device 921 or second fixing unit 901, and that it is possible to make arrival timing to the confluence be equal even if a sheet is conveyed on any path.

Other Modified Examples of First Embodiment

Other modified examples of the first embodiment will be also referred.

Although the cases of two or three fixing units are explained in the above-mentioned embodiment, the present invention is not limited to the number of fixing units. Further, although the structure of having a first path which has a fixing unit, and a second path which does not have it is explained in the previous embodiment, it is possible to similarly apply the present invention also to, for example, the structure having other fixing units in all the conveying paths. Owing to this, it is possible to obtain the same effect as that of the previous embodiment also in such conveying path structure that leads sheets to fixing units, whose setting differs, according to sheet material.

By using this embodiment, it becomes possible to cancel the shift of conveyance timing in the case that a first path length differs from a second path length near a confluence point of both paths. Thereby, also in the downstream of both paths, it is possible to continue sheet conveyance at the same interval as that before a sheet advances into a fixing portion regardless of that the sheet passed which path.

In addition, it is not necessary to always set a bifurcation point in the downstream of a second fixing device like the above-mentioned embodiment, but it is possible to similarly apply the present invention even in such structure that a second path may bypass a fixing unit which a sheet passes first. It can be formed that the second fixing device is provided in the downstream of the confluence point.

Owing to this effect, regardless of a job using only one between a first path and a second path and a mixing job using the first path and second path, for example, by turns, it becomes possible to perform image forming operation in the maximum productivity of the apparatus. In addition, since the sheet conveying interval after fixing is equalized, it is possible to stably perform also the motion control of a post treating apparatus located downstream.

Second Embodiment

Figure 12:
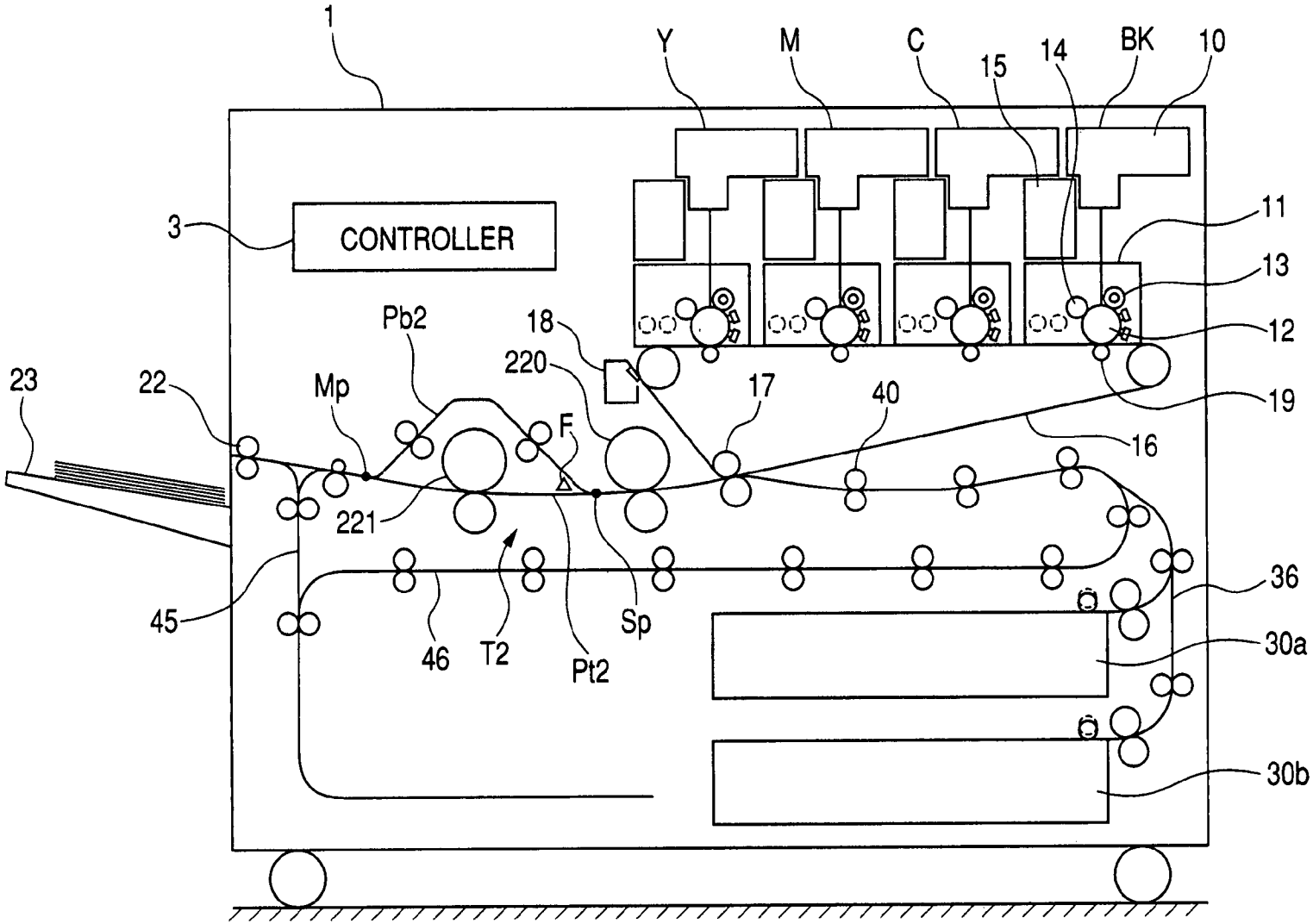
FIG. 12 is a schematic sectional diagram of an image forming apparatus of the second embodiment.

A second embodiment of the present invention will be explained using FIGS. 7, 8, 12, 18 and 19. FIG. 12 shows a schematic section of an image forming apparatus to which the present invention is applied. The same reference numerals are assigned to those in the same structure as that in the first embodiment, and detailed explanation will be omitted.

In the downstream of an image forming portion, an image fixing apparatus T2 is provided so as to fix a toner image on a sheet S as a permanent image. The image fixing apparatus T2 comprises a second fixing device 220, and a first fixing device 221 for performing additional fixing for a sheet having passed the second fixing device 220 according to a request. Both the second fixing device 220 and first fixing device 221 fix toner on a sheet with heat from a heating member, and nip pressure of a rotor pair, with nipping and conveying the sheet by the rotor pair.

The second fixing device 220 and first fixing device 221 are provided in a first path Pt2 which is a first conveying path. A second path (bypass) Pb2 is a second conveying path for bypassing the first fixing device and conveying a sheet. Thus, second path Pb2 branches from the first path Pt2 at a bifurcation point Sp which is provided in the downstream of the second fixing device 220 and in the upstream of the first fixing device 221. The second path Pb2 join again into the first path Pt2 at a confluence point Mp that is provided in the downstream of the first fixing device 221.

A flapper F which is a conveying path switching member for switching between paths in which each sheet is conveyed is provided at the bifurcation point Sp which is a bifurcation. By changing a position of the flapper F according to a request signal from the controller 3, it becomes possible to select either of the first path Pt2 and second path Pb2 for conveying a sheet.

Conveying rollers R1 and R2 which convey a sheet are provided in the second path Pb2. Conveying roller R1 and R2 are driven by drive motors M1 and M2, respectively (refer to FIG. 18). An after-unification conveying roller R3 is provided in the downstream of the confluence. The after-unification conveying roller R3 is driven by a drive motor M3. Then, as shown in the block diagram of FIG. 19, controller 3 controls the rotation of respective drive motors M1, M2 and M3 for driving respective conveying rollers R1, R2 and R3.

The detail of the image fixing apparatus based on the second embodiment will be explained below. FIG. 2 shows a schematic section of the image fixing apparatus T2 in this embodiment. Fixing structure comprising the second fixing device 220, first fixing device 221, first path Pt2, and second path Pb2 is such that the outline was explained previously. In addition, a sheet detection sensor SN for detecting a rear edge of a sheet to pass is provided near the downstream of the second fixing device 220. In comparison between path lengths from the bifurcation point Sp to the confluence point Mp, the second path Pb2 is longer than the first path Pt2 in this embodiment. Therefore, when a sheet is conveyed at the same speed on both conveying paths, the case that the sheet is conveyed through the second path Pb2 is more delayed in the timing when the sheet arrives at the confluence point, and this delay is drawn to the downstream as it is. When the conveyance timing of sheets is confused by the selection of a path, there arise problems such as confusion of the motion control of a double-sided conveying unit and a post treating apparatus which are positioned downstream, and a JAM caused by a sheet interval becoming excessively narrow. Hence, in this embodiment, this is canceled by the conveying control based on the present invention.

Figure 7:
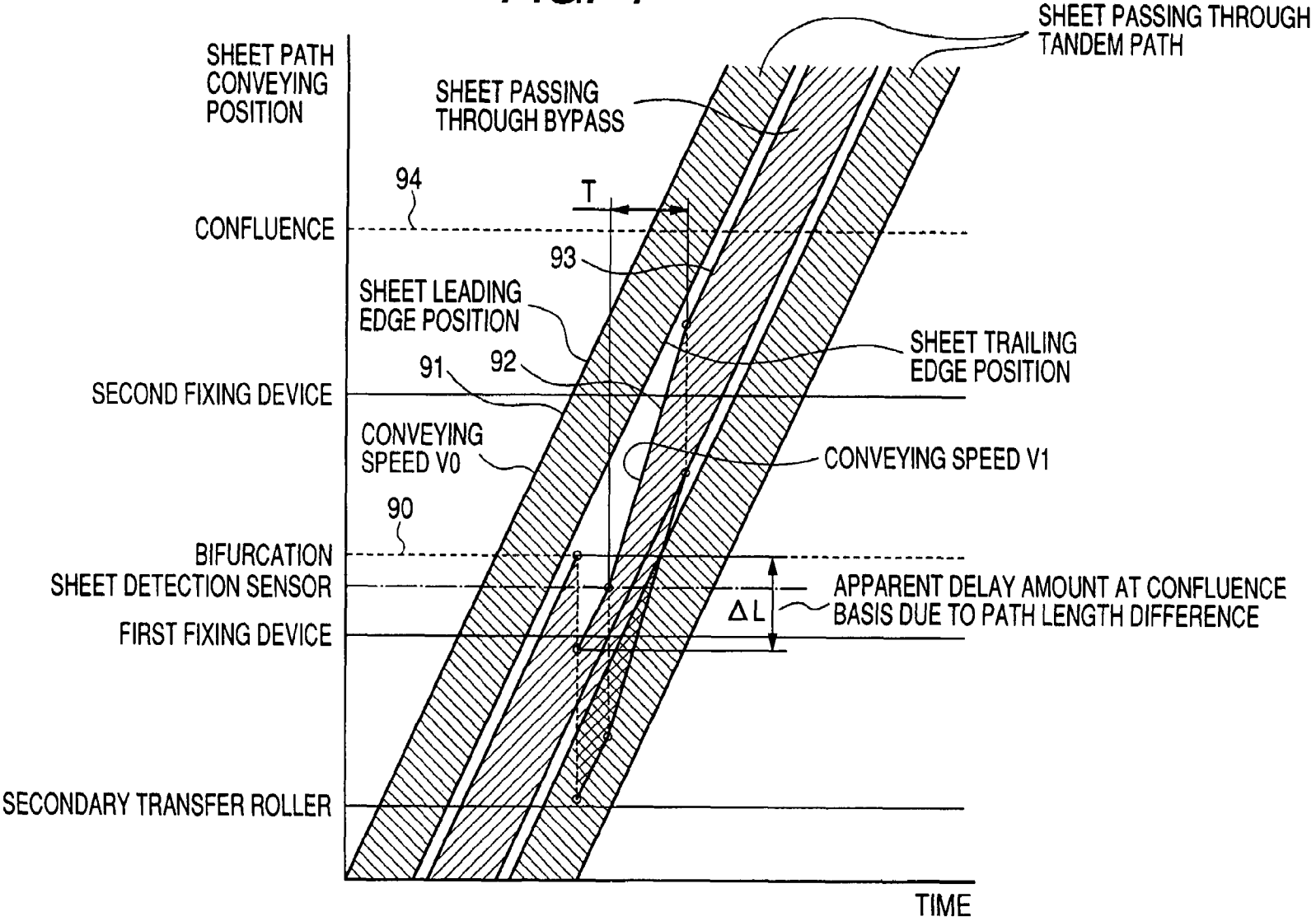
FIG. 7 is a timing chart of speed control in the structure of a second embodiment.
Figure 8:
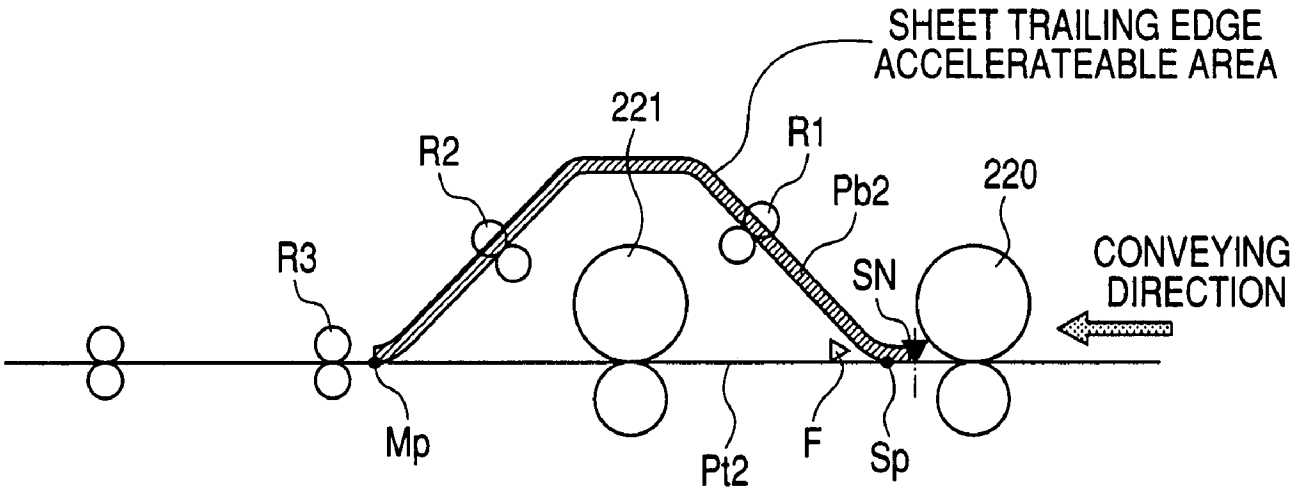
FIG. 8 is a sectional layout drawing in an image fixing apparatus of the second embodiment.

FIG. 7 is a conveyance timing chart in this embodiment. Here, let the conveying speed of a sheet in the first path Pt2 be Vt, and let the conveying speed of a sheet in the second path Pb2 be Vb. A sheet conveyed from a transferring portion usually passes the second fixing device 220 at conveying speed V0, and advances into either of the first path Pt2 and second path Pb2 according to a signal from the controller 3 at this speed (90). The sheet entering the first path Pt2 is conveyed at V0 even after a rear edge of the sheet passes out of the second fixing device 220 (91), and arrive at the confluence point Mp as it is (94). Thus, Vt and V0 are equal in this section.

On the other hand, a sheet entering the second path Pb2 is conveyed at the conveying speed V0 until the sheet passes out of the second fixing device 220, but when the sheet finishes passing out of the second fixing device 220, it is accelerated to V1 which is faster than V0 (92). It is detected by the sheet detection sensor SN that the rear edge of the sheet finished passing out of the second fixing device 220. Thus, the controller 3 controls the drive motors M1 and M2 driving the conveying rollers R1 and R2 so that the conveying speed of the sheet is accelerated from V0 to V1 on the basis of the rear edge of the sheet having been detected by the sheet detection sensor SN. Then, when the recovery equivalent to path length difference ΔL between the first path Pt2 and second path Pb2 is completed, the conveying speed will slow down to the original conveying speed V0 (93).

Although the speed V1 is a parameter which can be set arbitrarily, it is necessary to satisfy the following condition so as to increase the productivity of an image forming apparatus as much as possible.

When a preceding sheet passes out of the second path Pb2 and a subsequent sheet passes out of the first path Pt2, a sheet interval between the preceding sheet and subsequent sheet at the confluence point is shortened momentarily if acceleration recovery operation has not been completed before a rear edge of the preceding sheet passes out of the confluence point Mp. In this case, when the preceding sheet and subsequent sheet collide, there is a possibility that a jam may be generated. In order to prevent the sheet interval between the preceding sheet and subsequent sheet from being shortened momentarily, it is desirable that the accelerated conveyance of the sheet passing out of the second path Pb2 have completed before a rear edge of this sheet passes out of the confluence point Mp of the first path Pt2 and second path Pb2. Let a distance from the second fixing device 220 to the confluence point Mp through the second path Pb2 be Lb, let a distance from the second fixing device 220 to the sheet detection sensor SN be Ls, and let the time of the accelerated conveyance being performed be T, and a conditional expression for the completion of the acceleration recovery before a rear edge of a sheet passes out of a confluence point is as follows:

$$V1 \times T \leqq (Lb - Ls)$$

Let relative path length difference between the first path Pt2 and second path Pb2 be ΔL, and the accelerated conveyance time T is:

$$T = \Delta L / (V1 - V0)$$

Hence, when this is substituted so as to arrange the expression for V1:

$$V1 \geqq ((Lb - Ls)/(Lb - Ls - \Delta L)) \times V0$$

So long as this condition is satisfied, it is possible to achieve ideal control.

In addition, when performing acceleration and deceleration control with setting a rear edge of a sheet as a datum like this embodiment, an accelerated conveyance section differs according to the size of a sheet to be conveyed. Hence, it is desirable to enable independent speed control by making the drive of each conveying roller independent if possible. Thereby, it becomes easy to perform control of increasing productivity by shortening intervals between sheets to be conveyed, and it is possible to efficiently perform recovery control with a large conveying margin.

Now, applicative control structure, based on the same design philosophy as that of this embodiment, will be simply mentioned below.

Although the sheet detection sensor SN for detecting a rear edge of a sheet is located between the second fixing device 220 and bifurcation point Sp in the above-mentioned embodiment, this may be also in the downstream of the bifurcation point Sp. In addition, it is acceptable to adopt the structure in which a sheet detection sensor is located in the upstream of the second fixing device, and acceleration is started after predetermined time after a rear edge of a sheet passed out of this sensor (after time necessary for the completion of the sheet passing out of the second fixing device 220).

In addition, although the method of detecting a rear edge of a sheet is adopted in the above-mentioned embodiment, it is also possible to adopt another structure, for example, if a sheet detection sensor must be located separately in the downstream of a fixing unit because of a heat-resistant problem of the sheet detection sensor. For example, if only starting acceleration after calculating time for a rear edge of a sheet of passing out of a second fixing device on the basis of sheet length information during conveyance, which a controller recognizes, after detecting a front edge of the sheet, it is possible to obtain the same effects as those of the above-mentioned embodiment.

Figure 9:
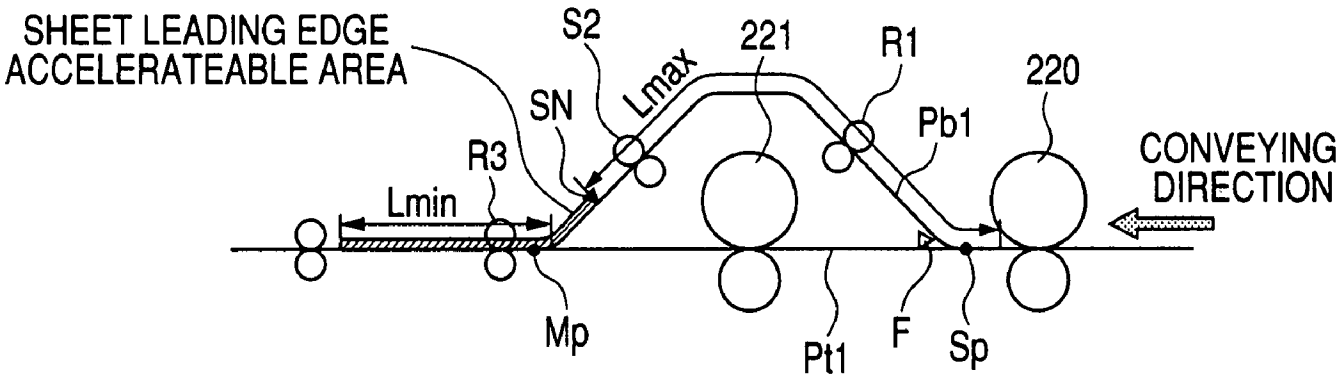
FIG. 9 is a sectional layout drawing of another structure similar to the second embodiment.

Furthermore, it is also good to locate the sheet detection sensor SN in the far downstream of the second fixing device (not less than the longest sheet length Lmax included in the specifications of an image forming apparatus) as shown in FIG. 9 as simply similar structure, and to start accelerated conveyance with making the arrival of this sensor a trigger. In this structure, since setting conditions of V1 for increasing the productivity described also in the above become severe, it is necessary to set V1 so that the accelerated conveyance of the shortest sheet may be complete before a rear edge of this sheet passes out of a confluence point on the basis of the shortest sheet (length Lmin) included in the specifications of the image forming apparatus. This is because an accelerated conveyable distance becomes shortest at the time of the shortest sheet if setting is subject to collision avoidance with a subsequent paper in the confluence point. On the other hand, there is a merit derived from that a section where the accelerated conveyance of a sheet is performed can be limited to a fixed section not depending on sheet size. Specifically, it is possible to achieve recovery operation in simple drive structure by such structure in which only the conveying rollers R2 and R3 which can be positioned in the lowermost stream can perform binary drive at conveying speed V0 and V1 when a sheet exists within an accelerating section, and such structure in which another conveying roller R1 in the upstream performs single drive at conveying speed V0 with a one-way clutch being provided. Let a distance from a conveying sensor to a confluence point be Ls2, a condition of V1 is as follows:

$$V1 \times T \leqq Ls2 + Lmin$$

Hence, $$V1 > ((Ls2 + Lmin)/(Ls2 + Lmin - \Delta L)) \times V0$$

First Modified Example of Second Embodiment

Figure 10:
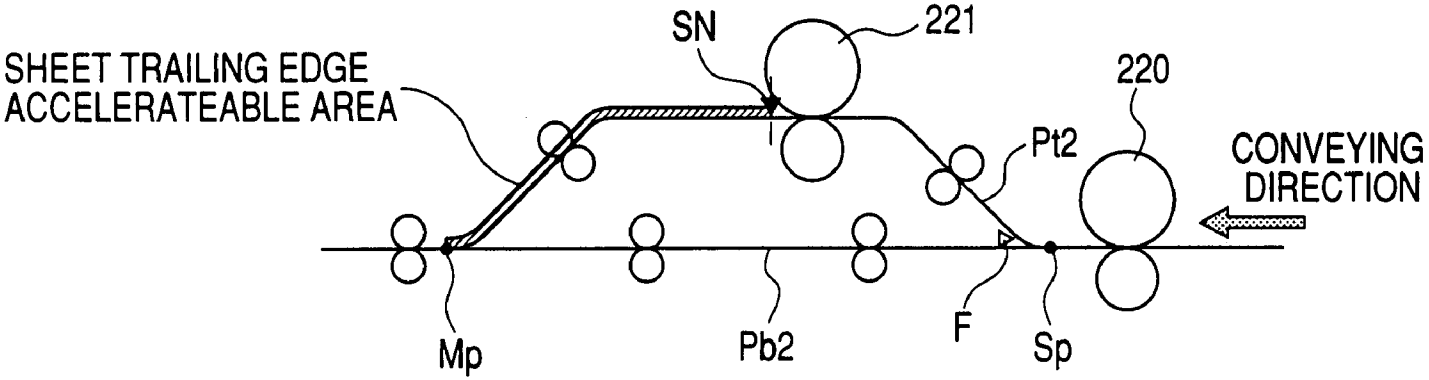
FIG. 10 is a sectional layout drawing showing a first modified example in the second embodiment.

In the above-mentioned second embodiment, although the present invention is applied to the fixing structure in which the second path Pb2 is longer than the first path Pt2, it is possible to obtain the same effect also in an image fixing apparatus in which the first path Pt2 is longer than the second path Pb2, as the first modified example of the second embodiment shown in FIG. 10. In this case, it is controlled that, after a rear edge of a sheet having passed the first path Pt2 passes out of the first fixing device 221, the accelerated conveyance of this sheet is performed. For the reason, a position where the accelerated speed can be started shifts to the downstream in comparison with the case that the first path Pt2 is longer than the second path Pb2. In addition, the position where the accelerated speed can be started can become the downstream of a confluence point depending on structure. In order to make recovery complete before a rear edge of a sheet passes out of the confluence point Mp, it is necessary to set V1 at higher speed, or to constitute a first path in longer length, and to locate the confluence point Mp in the downstream as much as possible, so as to assist this. As mentioned above, although it is possible to obtain the effect of the present invention similarly in the structure with a longer first path, it is recommendable in respect of the degree of margin to perform such design that the second path Pb2 becomes longer than the first path Pt2 when there is especially no restriction.

In addition, if a distance between the second fixing device 220 and first fixing device 221 is long enough with respect to a maximum sheet length Lmax, it is also possible that the second fixing device 220 conveys and drives a sheet at V0 and the first fixing device 221 conveys and drives a sheet at V1, and that an acceleration start point is set between both fixing units.

Second Modified Example of Second Embodiment

Figure 11:
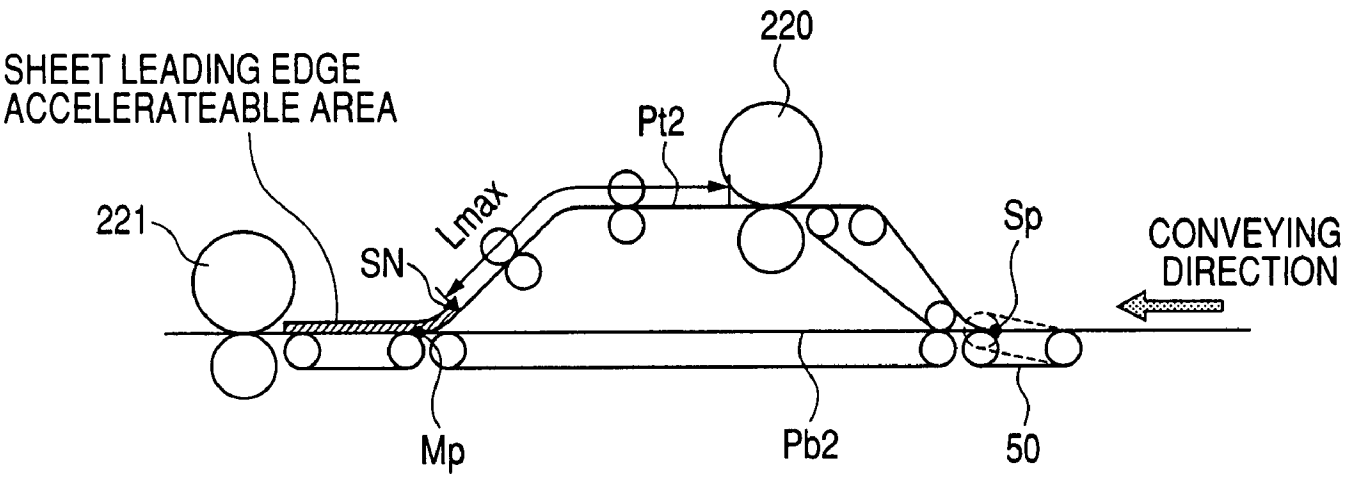
FIG. 11 is a sectional layout drawing showing a second modified example in the second embodiment.

Although the embodiment with the structure of branching to a first path and a second path behind a second fixing device is explained, the present invention is not limited to this but can be applied also to the structure in which a bifurcation point of a first path and a second path is located in the upstream of a second fixing device, that is, the structure in which the fixing unit which the second path bypasses is the fixing unit which a sheet passes first (refer to FIG. 11).

In this case, it is necessary to convey each sheet on which an unfixed image is born until the sheet enters the second fixing device 220 in the case of the first path Pt2, and until the sheet enters the first fixing device 221 in the downstream of a confluence point in the case of the second path Pb2. Hence, what is adopted as conveying means is a suction conveying belt which can convey a sheet with sucking and adsorbing it. In addition, what is provided as branching means in a bifurcation point is a branch conveying belt 50 which can swing-switch a conveying direction by a position control motor (not shown). The sheet detection sensor SN is located in a location of the first path Pt2 which is in the downstream not less than a maximum sheet length from the second fixing device 220. Similarly to the control method explained in the structure of the second embodiment as stated above, accelerated conveyance is started by making the arrival of a front edge of the sheet at this sensor a trigger, and recovery operation is made complete within a section until the front edge of the sheet arrives at the first fixing device 21.

Other Modified Examples of Second Embodiment

Other modified examples of the second embodiment will be explained.

In the above-mentioned second embodiment, although control is performed that performs accelerated conveyance only in a longer path and performs deceleration to normal conveying speed again after recovery completion of path length difference, the present invention is not limited to this speed control. For example, even if a sheet passes any of a first path and a second path in the case where a sheet reversing and discharging mechanism which reverses a front surface and a rear surface of a sheet and discharges the sheet is located in the downstream of a fixing unit, it is necessary to accelerate the conveying speed when the sheet advances into the sheet reversing and discharging mechanism, so as to reverse the sheet without the sheet colliding with a subsequent sheet. In such structure, it is possible to cancel a timing shift, which is caused by the path length difference between both conveying paths, by moving acceleration start timing on a longer path ahead rather than that on a shorter path between the first path and second path. Let the difference of the accelerating start timing at this time be ΔT, and $$\Delta T=\Delta L/(V1-V0)$$

(When the acceleration start timing on the longer path is set to be earlier by ΔT rather than that on the shorter path, it is possible to recover the path length difference ΔL.)

In addition, in the previous embodiment, although accelerated conveyance time is a fixed value determined from the path length difference and conveying speed difference between the first path and second path, the present invention is not limited to this. For example, it is also acceptable to be the variable control in which optimal accelerating time is determined on the basis of a shift obtained by comparing the timing, when a sheet detection sensor in the longer path turns on, with theoretical on-timing. When using this control method, even if sheet conveyance speed at the time of passing a fixing unit is fluctuated by disturbances such as temperature control conditions and aged deterioration of the fixing unit, and the characteristics of sheet material, it is possible to perform recovery operation with corresponding to delay amount of every case flexibly.

Furthermore, in the previous embodiment, although the conveying speed on a shorter path is set to be equal to the conveying speed V0 in the second fixing device throughout. Nevertheless, since the spirit of the present invention is in the respect of canceling the path length difference between both paths within predetermined time, it is acceptable to have a plurality of conveying speeds so long as it is a range which does not disturb this object.

Moreover, although the case of two fixing units is explained in the previous embodiment, the present invention is not limited to the number of fixing units, but can be similarly applied also to the fixing structure which consists of three or more fixing units.

It can be formed that the second fixing device is provided on the second path. In this case, the second fixing device is another type fixing device different from the first fixing device.

By using the second embodiment, it becomes possible to restore a shift of conveyance timing which is caused by path length difference near a confluence point of both paths also in an image forming apparatus with the structure of a plurality of fixing units where the length of a first path differs from that of a second path. Thereby, also in the downstream of both paths, it is possible to continue sheet conveyance at the same interval as that before a sheet advances into a fixing portion regardless of that the sheet passed which path.

Owing to this effect, regardless of whether a continuous job using only one between a first path and a second path or a mixing job discontinuously using the first path and second path by turns, it becomes possible to perform image forming operation in the maximum productivity of the apparatus. In addition, since the sheet conveying intervals after fixing are equalized, it is possible to stably perform also the motion control of post treating apparatuses such as a sheet reversing mechanism, a both-side path, and a stapler, which are located downstream.

Third Embodiment

Figure 17:
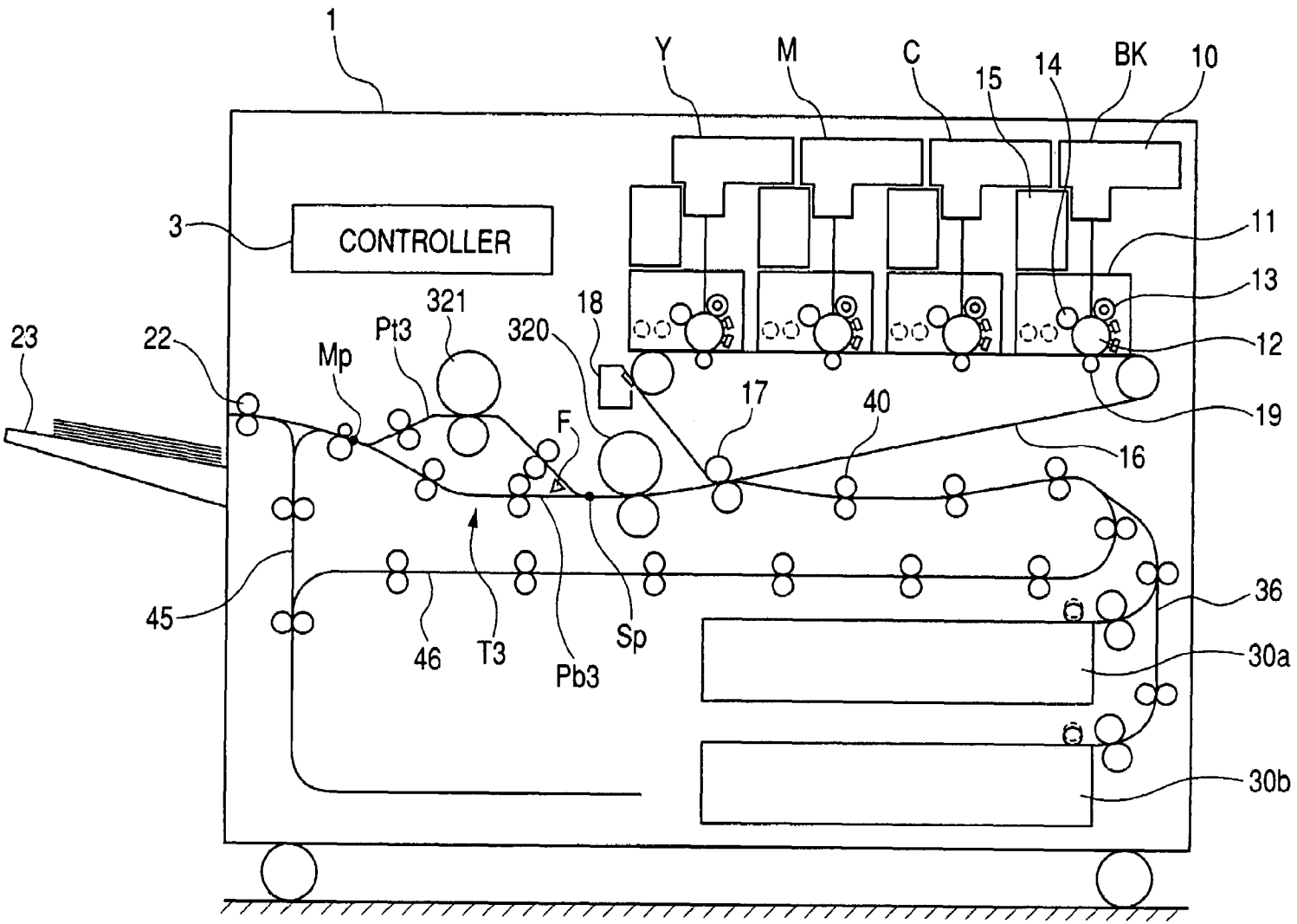
FIG. 17 is a schematic sectional diagram of an image forming apparatus in the third embodiment.
Figure 18:
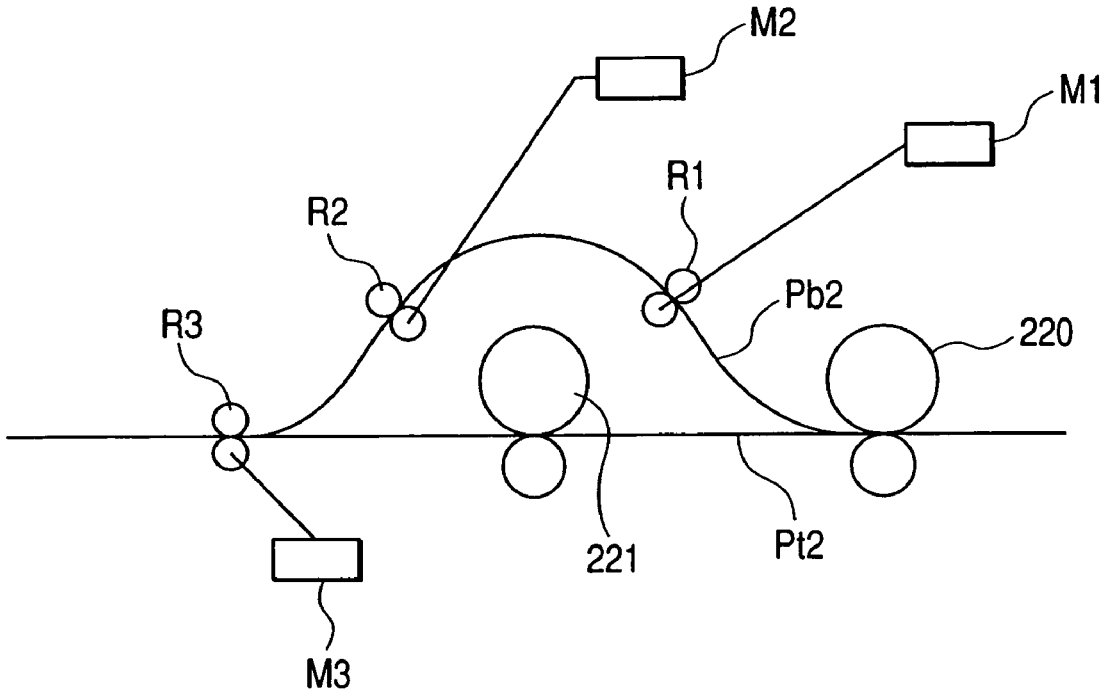
FIG. 18 is a structural diagram of the image fixing apparatus of the second embodiment.
Figure 19:
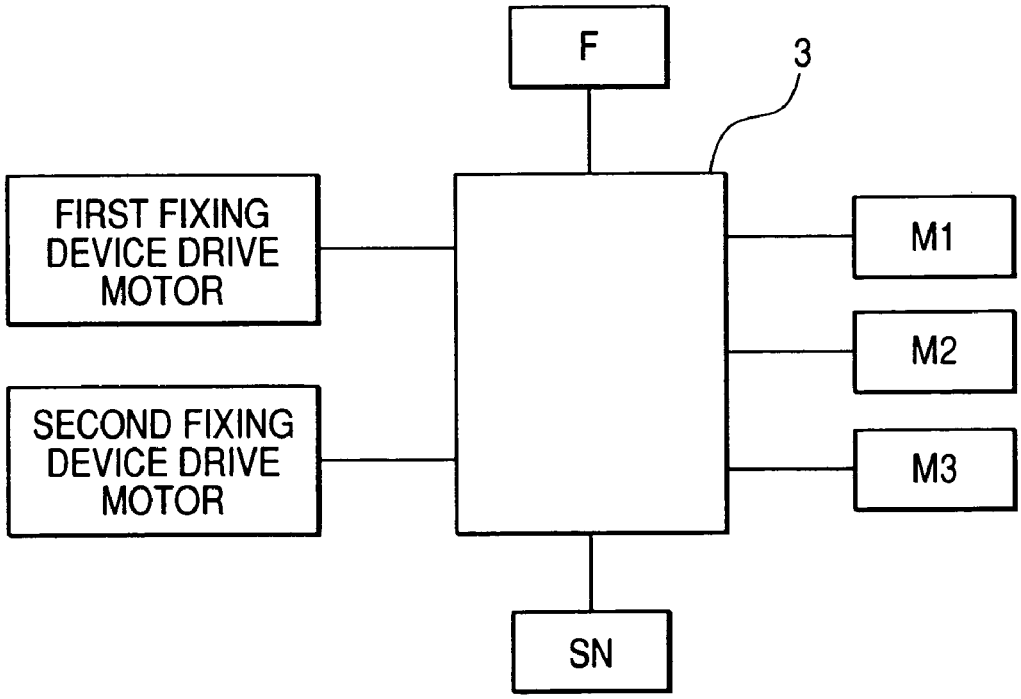
FIG. 19 is a block diagram in the image fixing apparatus of the second embodiment.

A third embodiment of the present invention will be explained using FIGS. 13, 14 and 17. FIG. 17 shows a schematic section of an image forming apparatus to which the present invention is applied. The same reference numerals will be assigned to those in the same structure as that in the first embodiment, and detailed explanation will be omitted.

In the downstream of an image forming portion, an image fixing apparatus T2 is provided so as to fix a toner image on a sheet S as a permanent image. An image fixing apparatus T2 comprises a second fixing device 320, and a first fixing device 321 for performing additional fixing for a sheet passing the second fixing device 320 according to a request. Both the second fixing device 320 and first fixing device 321 fix toner on a sheet with heat from a heating member, and nip pressure of a rotor pair, with nipping and conveying the sheet by the rotor pair.

The second fixing device 320 and first fixing device 321 are provided in a first path Pt3 which is a first conveying path. A second path (bypass) Pb3 is a second conveying path for bypassing the first fixing device and conveying a sheet. Thus, the second path Pb3 branches from the first path Pt3 at a bifurcation point Sp which is provided in the downstream of the second fixing device 320 and in the upstream of the second fixing device 321. The second path Pb3 join again into the first path Pt3 at a confluence point Mp that is provided in the downstream of the first fixing device 321.

A flapper F which is a conveying path switching member for switching between paths in which each sheet is conveyed is provided at the bifurcation point Sp which is a bifurcation. By changing a position of the flapper F according to a request signal from the controller 3, it becomes possible to select either of the first path Pt3 and second path Pb3 for conveying a sheet.

Conveying rollers R31 and R32 which convey a sheet are provided in the second path Pb3. The conveying rollers R31 and R32 are driven by drive motors M31 and M32, respectively. In addition, conveying rollers R33 and R34 are provided in the first path Pt3. The conveying rollers R33 and R34 are driven by drive motors M33 and M34, respectively. The after-unification conveying roller R35 is provided in the downstream of the confluence point Mp and is driven by a drive motor M35. Similarly to the second embodiment, the controller 3 controls the rotation of drive motors for driving respective conveying rollers.

The detail of the image fixing apparatus T3 based on the present invention will be explained below. FIG. 14 shows a schematic section of the image fixing apparatus T3 in this embodiment. Fixing structure comprising the second fixing device 320, first fixing device 321, first path Pt3, and second path Pb3 is such that the outline was explained previously, in comparison between path lengths from the bifurcation point Sp to the confluence point Mp, the first path Pt3 is longer than the second path Pb3 in this embodiment. Therefore, when a sheet is conveyed at the same speed on both conveying paths, arrival timing at the confluence point differs depending on which path a sheet passed, and this influence is drawn to the downstream as it is. When the conveyance timing of a sheet is confused by path selection, there arise problems represented by malfunctions of a double-sided conveying unit, a post treating apparatus, and the like, which are positioned downstream, and a JAM caused by a sheet interval becoming excessively narrow. Hence, in this embodiment, this is canceled by the conveyance control based on the present invention.

Figure 13:
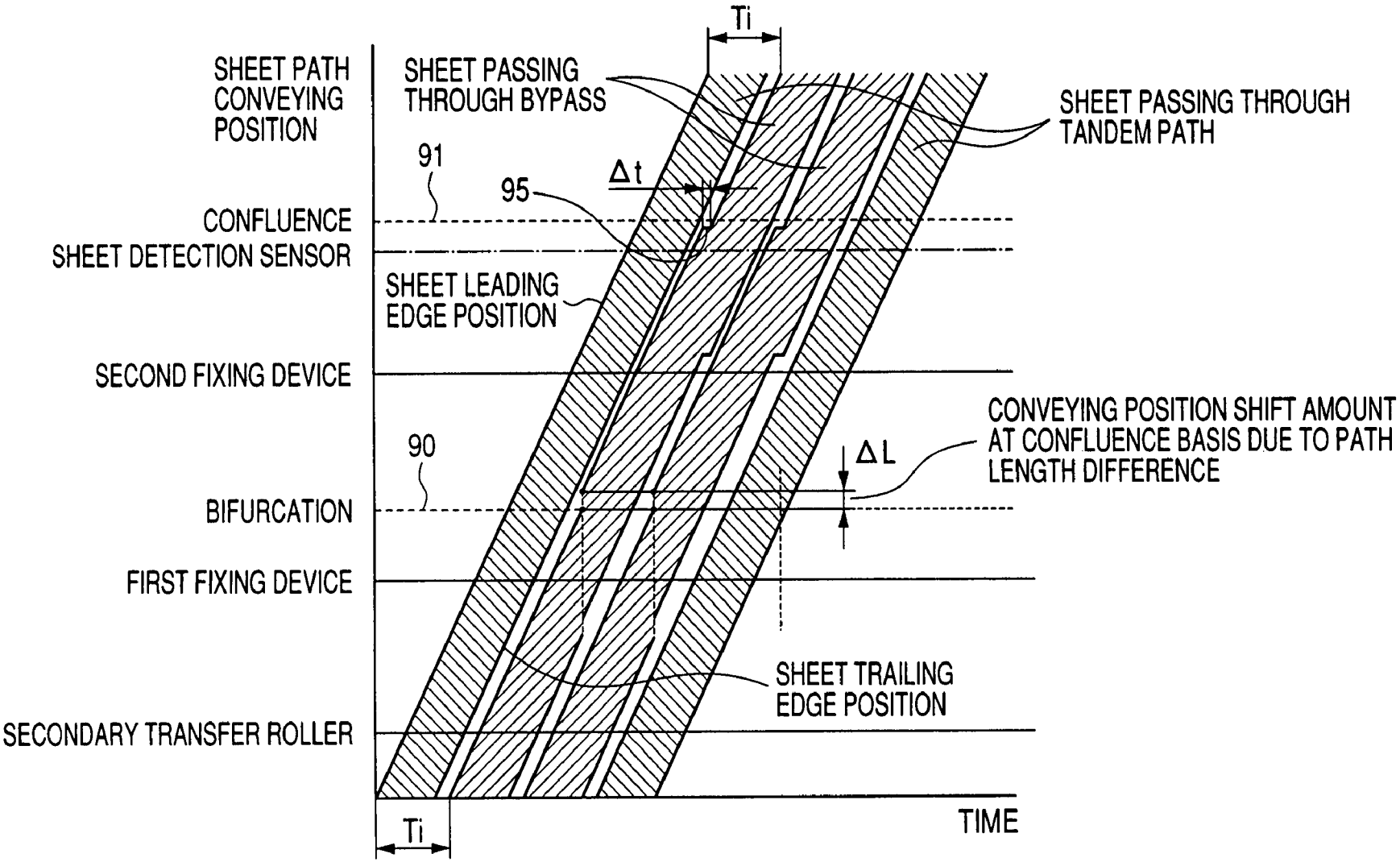
FIG. 13 is a conveyance timing chart in the structure of a third embodiment.
Figure 14:
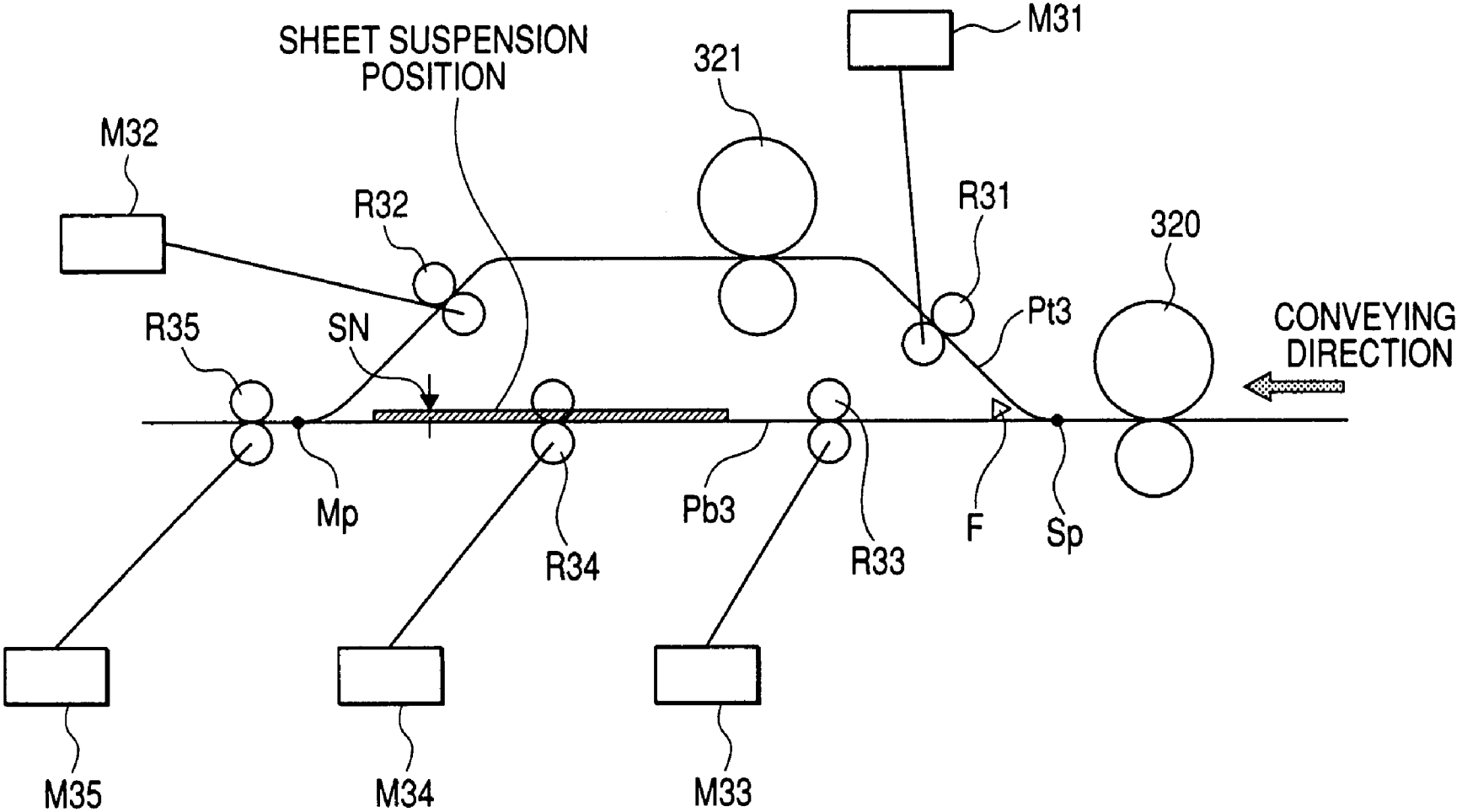
FIG. 14 is sectional layout drawing in an image fixing apparatus of the third embodiment.

FIG. 13 is a conveyance timing chart in the third embodiment. A sheet which is continuously conveyed at a conveying interval Ti and speed V0 from a transferring portion passes the second fixing device 320, and thereafter, is led into either of the first path Pt3 and second path Pb3 according to a signal from the controller 3 (90). The sheet is succeedingly conveyed at speed V0 even on either conveying path. In order to prevent the dispersion in the conveyance timing resulting from path length difference ΔL between the first path Pt3 and second path Pb3, the conveyance timing at the time of a sheet passing the first path with longer length is made positive, and timing correction control which will be explained in detail below is performed to a sheet which passes the second path.

The sheet which advances into the second path Pb3 arrives soon at the sheet detection sensor SN located in this path. When this sensor turns on, the controller outputs a signal which stops the drive of a conveying roller after the predetermined time from that time, and suspends sheet conveyance. Let the stopping time at this time be Δt, Δt can be theoretically obtained from the known path length difference ΔL and conveying speed V0 as follows:

$$\Delta t = \Delta L / V0$$

In addition, needless to say, it is necessary to perform calculation with taking sheet movement at the time of motor acceleration and deceleration into consideration when driving a conveying roller with a stepping motor. In this embodiment, after making the sheet suspended by the stopping time Δt obtained from the theoretical calculation, conveying operation is resumed. Owing to this control, the sheet is conveyed at the uniform conveying interval Ti after the arrival at the confluence point similarly to that at the time of the passage from the bifurcation point.

Furthermore, there is an upper limit in path length difference ΔL between the first path Pt3 and second path Pb3 which is absorbable by the timing correction control by suspension. That is, it is a condition that two consecutive sheets which advance to the second path Pb3 do not collide with each other at the time of the suspension control. In addition, the case that there is a mechanism which can make a sheet conveyance interval negative temporarily, that is, can overlap the sheets is excluded here. Let the length of a sheet during conveyance be Ls, and a condition that a preceding sheet and a subsequent sheet do not collide is that the distance between sheets before suspension control, ((Ti×V0)−Ls) does not become zero or less during the cancellation of the path length difference ΔL by suspension.

The following conditional expression stands:

$$((Ti \times V0) - Ls) - \Delta L > 0$$

When this is rewritten, $$\Delta L < (T1 \times V0) - Ls$$

Hence, the upper limit of ΔL can be calculated. It is necessary to determine structure at the time of an apparatus design so as not to exceed this value.

In addition, although paper conveyance is suspended by the predetermined time Δt, which is obtained theoretically, in this embodiment, it is acceptable to adopt a control method, which resumes conveyance at predetermined timing according to the operation timing of an image forming apparatus which the controller 3 controls, instead of the control of fixing the stopping time like this. When utilizing this control method, it is possible to perform such flexible control that detects a shift of the conveyance timing of a sheet which passes a longer conveying path, and gives a sheet conveyance restart trigger under suspension according to the shift.

Other Modified Examples of Third Embodiment

Although only one suspension point is set within the first path Pt3 in the above-mentioned third embodiment, the present invention is not limited to this, but it is also acceptable to adopt the structure that stopping can be performed at two or more locations. The modified example of the third embodiment where two suspension points are set will be explained below.

Figure 15:
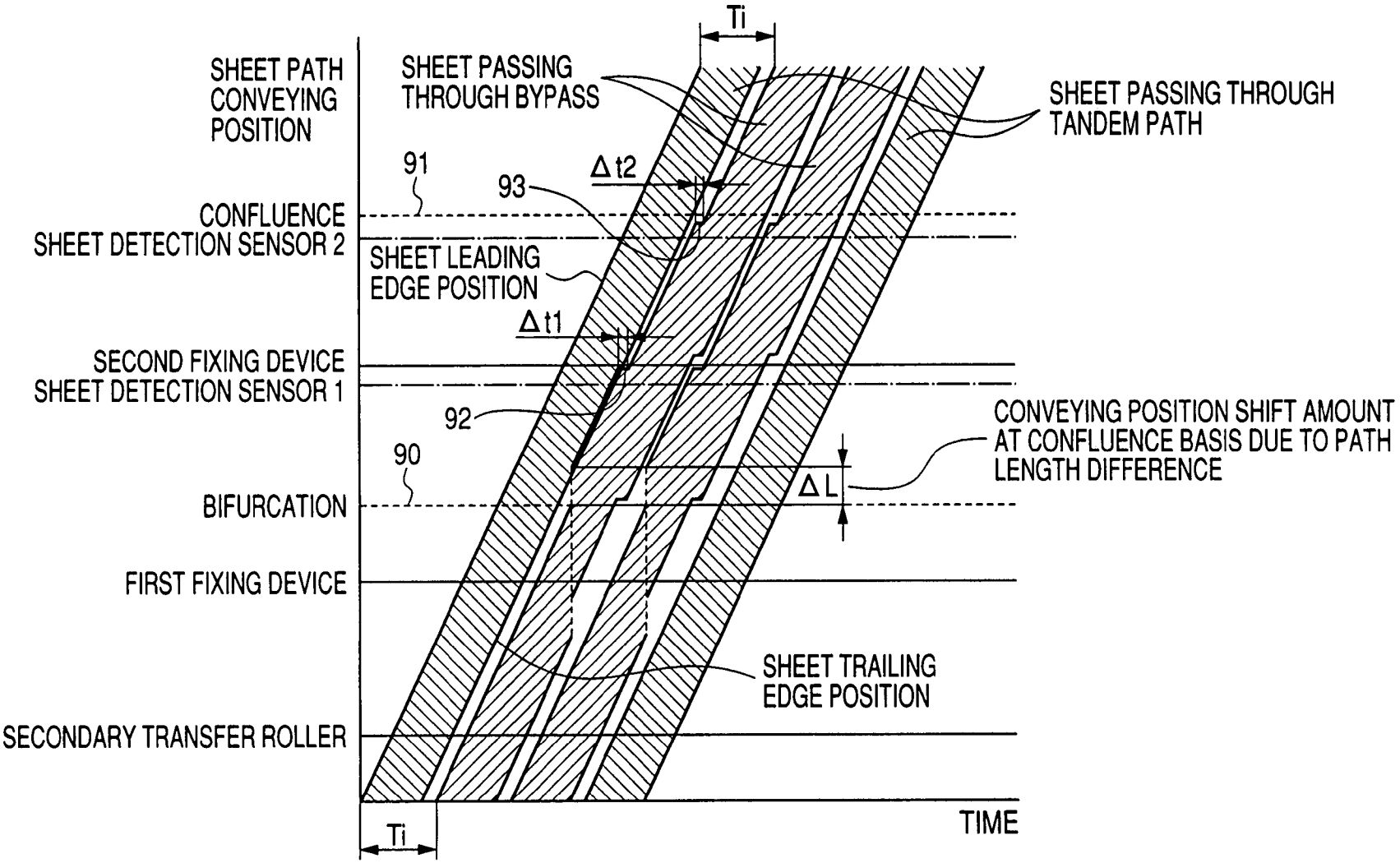
FIG. 15 is a conveyance timing chart in a modified example of the third embodiment.
Figure 16:
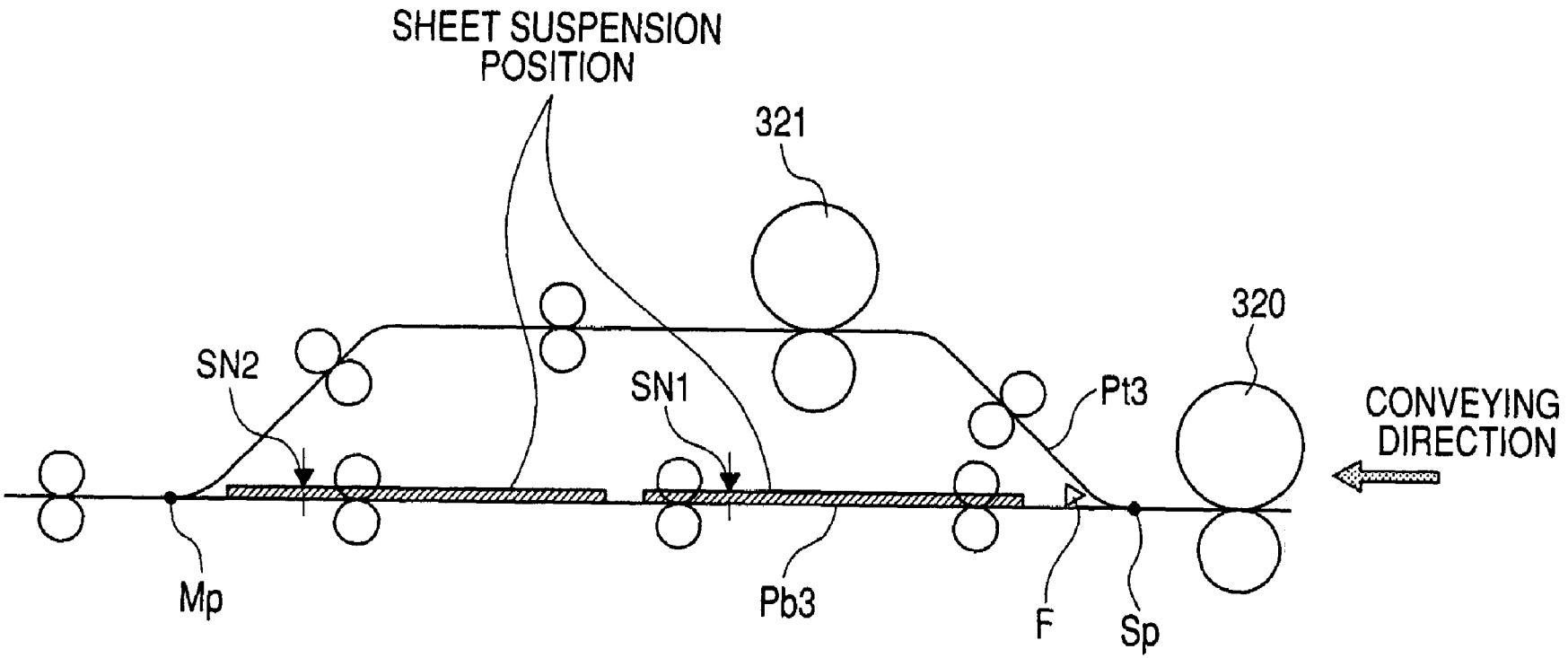
FIG. 16 is a sectional layout drawing of a modified example of the third embodiment.

FIG. 16 shows a schematic section of structure of a fixing portion in this modified example, and FIG. 15 is a conveyance timing chart of a sheet in this modified example. In the second path Pb3, two sensors, that is, a first sheet detection sensor SN1 and a second sheet detection sensor SN2 are provided. When a sheet passes through a bifurcation point (90) to advance into the second path Pb3, and arrives at each sensor, conveyance operation is stopped after predetermined time from that time, and conveyance is restarted after Δt1 and Δt2, respectively (92 and 93). That is, a sheet stops twice during from advancing into the second path Pb3 to arriving at the confluence point Mp, and a shift of the conveyance timing after the confluence point (91) resulting from the path length difference ΔL is canceled through the timing correction operation using the total stopping time Δt1 +Δt2 thereby.

Let conveying speed be V0, and there is the following relation between the stopping time Δt1 and Δt2, and path length difference ΔL between the first path and second path similarly to the above-mentioned third embodiment:

$$\Delta t1+\Delta t2=\Delta L/V0$$

Let a sheet length be Ls, and conditional expressions for two consecutive sheets advancing into the first path and not colliding by two times of suspension control are as follows:

$$\Delta t1<Ti-(Ls/V0)$$

$$\Delta t2<Ti-(Ls/V0)$$

Hence, when compiling these, a constraint of path length difference ΔL is obtained as follows:

$$\Delta L<2\times((Ti\times V0)-Ls)$$

From the above conditional expression, it turns out that the path length difference absorbable by the timing correction control doubles owing to making suspension points two locations. In addition, since the constraints of Δt1 and Δt2 are the same, it can be said that what is necessary is just to make both setting values fundamentally be the same.

Furthermore, in this modified example, it is switched according to the size of a sheet conveyed whether suspension is performed at two locations or only one location. In the case of the size that a rear edge of a sheet overlaps with a stop position by the first sheet detection sensor SN1 when a sheet is made to be suspended in a stop position by the second sheet detection sensor SN2 (or, the size that a rear edge of as sheet has not passed out of the second fixing device 320 when the sheet is stopped in a stop position by the first sheet detection sensor SN1), timing correction control is performed only in the stop position by the second sheet detection sensor SN2. Naturally, since the path length difference ΔL cannot be absorbed when conveyance is performed at the same sheet interval as that in the case of stopping at two locations, an initial sheet conveyance interval is widened by its length for a margin to be secured.

Other Modified Examples of Third Embodiment

Although the typical embodiments in the third embodiment are as explained above, other embodiments will be also mentioned below.

Although the fixing structure in which a second path is shorter than a first path is explained in the third embodiment and modified examples of the third embodiment which are described above, on the contrary, it is also possible to apply the present invention to the fixing structure in which a first path is shorter than a second path. However, if a sheet is not in the state in which a rear edge of the sheet has passed out of a fixing unit in a first path, suspension is impossible. Hence, a path length from the fixing unit to a confluence point must fully be secured, and hence, space restrictions become severe rather than the third embodiment or its modified examples as apparatus structure.

In addition, although the case of two fixing units is explained in the previous third embodiment and modified examples of the third embodiment, the present invention is not limited to the number of fixing units, but can be similarly applied also to the fixing structure which consists of three or more fixing units.

Furthermore, it is not necessary to always set a bifurcation point in the downstream of a second fixing device like the third embodiment and modified examples of the third embodiment, but it is possible to apply the present invention to the case that a second fixing unit is located in a first path (in other words, the case that a second fixing device provided in the upstream is included in objects for bypassing of a second path). In this case, it is necessary to convey each sheet, on which an unfixed image is placed, in a section to a sheet arriving at a second fixing device in regard to a first path, and in a section from a sheet passing through a confluence point to the sheet arriving at a second fixing unit in regard to a second path. Therefore, specifically, what is requested is the structure of conveying a sheet by a suction conveying belt, which is divided into several pieces so that the timing correction control of the present invention can be achieved.

It can be formed that the second fixing device is provided on the second path. In this case, the second fixing device is another type fixing device different from the first fixing device.

In the third embodiment, in an image forming apparatus with the structure having a plurality of fixing units where lengths of a first path and a second path differ, it is possible to perform stable sheet conveyance at a uniform conveyance interval, which is the same as that before a sheet advancing into a fixing portion, even in the downstream of a confluence point of both paths regardless of whether the sheet has passed out of any of the paths.

Hence, regardless of a job using only one between a first path and a second path and a mixing job using the first path and second path by turns, it becomes possible to perform image forming operation in the maximum productivity of the apparatus. In addition, since the sheet conveying intervals after fixing are equalized, it is possible to stably perform also the motion control of post treating apparatuses such as a sheet reversing mechanism, a both-side path, and a stapler, which are located downstream.

Also in any of the above-mentioned embodiments, even if both of a first conveying path and a second path conveying path are used into one job, it becomes possible to cancel a shift of conveyance timing. Thus, it is possible to continue sheet conveyance after the unification of both conveying paths at the same sheet interval as that before a bifurcation regardless of whether a sheet has passed which conveying path. In addition, it is possible to prevent causing a malfunction derived from interfering with conveying motion control after joining, and causing a jam because of a preceding sheet colliding with a subsequent sheet.

This application claims priority from Japanese Patent Application No. 2004-110182 filed Apr. 2, 2004, which is hereby incorporated by reference herein.

What is claimed is:

1. An image fixing apparatus comprising:

a first conveying path on which a sheet is conveyed;

a first fixing unit that fixes a toner image on a sheet conveyed on said first conveying path;

a second conveying path on which a sheet is conveyed, wherein said second conveying path branches from said first conveying path in a bifurcation provided on an upstream of said first fixing unit and joins into said first conveying path in a confluence provided on a downstream of said first fixing unit; and a second fixing unit provided on an upstream of said bifurcation or on a downstream of said confluence, wherein time to convey a sheet from said bifurcation to said confluence through said first conveying path and time to convey a sheet from said bifurcation to said confluence through said second conveying path are nearly equal, wherein one of said first conveying path and said second conveying path is longer than the other in regard to length from said bifurcation to said confluence, and wherein in at least a certain portion of the longer conveying path, a sheet on the longer conveying path is conveyed at a conveying speed faster than a conveying speed of a sheet conveyed on the shorter conveying path.

2. An image fixing apparatus comprising:

a first conveying path on which a sheet is conveyed;

a first fixing unit that fixes a toner image on a sheet conveyed on said first conveying path;

a second conveying path on which a sheet is conveyed, wherein said second conveying path branches from said first conveying path in a bifurcation provided on an upstream of said first fixing unit and joins into said first conveying path in a confluence provided on a downstream of said first fixing unit; and a second fixing unit provided on an upstream of said bifurcation or on a downstream of said confluence, wherein time to convey a sheet from said bifurcation to said confluence through said first conveying path and time to convey a sheet from said bifurcation to said confluence through said second conveying path are nearly equal, wherein one of said first conveying path and said second conveying path is longer than the other in regard to length from said bifurcation to said confluence, wherein a sheet conveying speed in said bifurcation is at a first speed, and a sheet to be conveyed regardless of said first conveying path and said second conveying path is conveyed at second speed faster than said first speed at a certain portion of a conveying path, and wherein in the longer conveying path, time from a front edge of a sheet passing said bifurcation to acceleration to said second speed is shorter than that on the shorter conveying path.

3. An image fixing apparatus comprising:

a first conveying path on which a sheet is conveyed;

a first fixing unit that fixes a toner image on a sheet conveyed on said first conveying path;

a second conveying path on which a sheet is conveyed, wherein said second conveying path branches from said first conveying path in a bifurcation provided on an upstream of said first fixing unit and joins into said first conveying path in a confluence provided on a downstream of said first fixing unit; and a second fixing unit provided on an upstream of said bifurcation or on a downstream of said confluence, wherein time to convey a sheet from said bifurcation to said confluence through said first conveying path and time to convey a sheet from said bifurcation to said confluence through said second conveying path are nearly equal, wherein one of said first conveying path and said second conveying path is shorter than the other in regard to length from said bifurcation to said confluence, and wherein conveyance of a sheet is suspended before said confluence on the shorter conveying path.

4. An image fixing apparatus comprising:

a first conveying path on which a sheet is conveyed;

a first fixing unit that fixes a toner image on a sheet conveyed on said first conveying path;

a second conveying path on which a sheet is conveyed, wherein said second conveying path branches from said first conveying path in a bifurcation provided on an upstream of said first fixing unit and joins into said first conveying path in a confluence provided on a downstream of said first fixing unit; and a second fixing unit provided upstream of said bifurcation, downstream of said confluence, or on said second conveying path, wherein one of said first conveying path and said second conveying path is longer than the other in regard to length from said bifurcation to said confluence, wherein time to convey a sheet from said bifurcation to said confluence through said first conveying path and time to convey a sheet from said bifurcation to said confluence through said second conveying path are nearly equal, and wherein in at least a certain portion of the longer conveying path, a sheet on the longer conveying path is conveyed at a conveying speed faster than a conveying speed of a sheet conveyed on the shorter conveying path.

5. An image fixing apparatus comprising:

a first conveying path on which a sheet is conveyed;

a first fixing unit that fixes a toner image on a sheet conveyed on said first conveying path;

a second conveying path on which a sheet is conveyed, wherein said second conveying path branches from said first conveying path in a bifurcation provided on an upstream of said first fixing unit and joins into said first conveying path in a confluence provided on a downstream of said first fixing unit; and a second fixing unit provided upstream of said bifurcation, downstream of said confluence, or on said second conveying path, wherein one of said first conveying path and said second conveying path is longer than the other in regard to length from said bifurcation to said confluence, wherein time to convey a sheet from said bifurcation to said confluence through said first conveying path and time to convey a sheet from said bifurcation to said confluence through said second conveying path are nearly equal, wherein a sheet conveying speed in said bifurcation is at first speed, and a sheet to be conveyed regardless of said first conveying path and said second conveying path is conveyed at second speed faster than said first speed at a certain portion of a conveying path, and wherein in the longer conveying path, time from a front edge of a sheet passing said bifurcation to acceleration to said second speed is shorter than that on the shorter conveying path.

6. An image fixing apparatus comprising:

a first conveying path on which a sheet is conveyed;

a first fixing unit that fixes a toner image on a sheet conveyed on said first conveying path;

a second conveying path on which a sheet is conveyed, wherein said second conveying path branches from said first conveying path in a bifurcation provided on an upstream of said first fixing unit and joins into said first conveying path in a confluence provided on a downstream of said first fixing unit; and a second fixing unit provided upstream of said bifurcation, downstream of said confluence, or on said second conveying path, wherein one of said first conveying path and said second conveying path is longer than the other in regard to length from said bifurcation to said confluence, wherein time to convey a sheet from said bifurcation to said confluence through said first conveying path and time to convey a sheet from said bifurcation to said confluence through said second conveying path are nearly equal, and wherein conveyance of a sheet is suspended before said confluence on the shorter conveying path.

7. An image fixing apparatus comprising:

a first conveying path on which a sheet is conveyed;

a first fixing unit that fixes a toner image on a sheet conveyed on said first conveying path;

a second conveying path on which a sheet is conveyed, wherein said second conveying path branches from said first conveying path in a bifurcation provided on an upstream of said first fixing unit and joins into said first conveying path in a confluence provided on a downstream of said first fixing unit; and a second fixing unit provided on said second conveying path, wherein one of said first conveying path and said second conveying path is longer than the other in regard to length from said bifurcation to said confluence, and wherein time to convey a sheet from said bifurcation to said confluence through said first conveying path and time to convey a sheet from said bifurcation to said confluence through said second conveying path are nearly equal, and wherein said first fixing unit is a type of fixing unit different from the second fixing unit.

* * * * *

UNITED STATES PATENT AND TRADEMARK OFFICE

CERTIFICATE OF CORRECTION

PATENT NO. : 7,389,062 B2
APPLICATION NO. : 11/096128
DATED : June 17, 2008
INVENTOR(S) : Hashimoto et al.

It is certified that error appears in the above-identified patent and that said Letters Patent is hereby corrected as shown below:

On the title page: Item [73] should read -- Canon Kabushiki Kaisha --.

Signed and Sealed this

Second Day of December, 2008

JON W. DUDAS
*Director of the United States Patent and Trademark Office*

UNITED STATES PATENT AND TRADEMARK OFFICE

CERTIFICATE OF CORRECTION

PATENT NO. : 7,389,062 B2
APPLICATION NO. : 11/096128
DATED : June 17, 2008
INVENTOR(S) : Hashimoto et al.

It is certified that error appears in the above-identified patent and that said Letters Patent is hereby corrected as shown below:

ON THE TITLE PAGE
AT (57) Abstract:
Lines 6 and 9, “on a upstream” should read --on an upstream--.

COLUMN 2:
Line 19, “on a” should read --on an--.
Line 23, “on a” should read --on an--.

COLUMN 3:
Line 45, “an yellow” should read --a yellow--.
Line 46, “given” should read --given a--.

COLUMN 4:
Line 24, “join” should read --joins--.
Line 44, “again the sheet” should read --the sheet again--.
Line 55, “beings” should read --being--.

COLUMN 6:
Line 63, “differ,” should read --differs--.
Line 64, “that” should read --that the--.
Line 65, “be” should read --not--.
Line 66, “not” should read --be--.

COLUMN 7:
Line 16, “be” should read --also--.
Line 17, “also” should read --be--.

COLUMN 8:
Line 8, “second” should read --the second--.
Line 11, “join” should read --joins--.
Line 62, “arrive” should read --arrives--.

COLUMN 9:
Line 28, “have completed” should read --has been completed--.

COLUMN 11:
Line 14, “first” should read --the first--.

UNITED STATES PATENT AND TRADEMARK OFFICE

CERTIFICATE OF CORRECTION

PATENT NO. : 7,389,062 B2
APPLICATION NO. : 11/096128
DATED : June 17, 2008
INVENTOR(S) : Hashimoto et al.

It is certified that error appears in the above-identified patent and that said Letters Patent is hereby corrected as shown below:

COLUMN 12:
Line 42, “type” should read --type of--.

COLUMN 13:
Line 22, “join” should read --joins--.

COLUMN 14:
Line 13, “$\Delta\tau$, $\Delta\tau$” should read --$\Delta\tau$. $\Delta\tau$--.

COLUMN 15:
Line 15, “during” should be deleted.
Line 64, “be also” should read --also be--.

COLUMN 16:
Line 56, “into” should read --in--.

Signed and Sealed this

Tenth Day of February, 2009

John Doll

JOHN DOLL
*Acting Director of the United States Patent and Trademark Office*